US005873137A

United States Patent [19]

Yavets-Chen

[11] Patent Number: 5,873,137

[45] Date of Patent: Feb. 23, 1999

[54] PNUEMATIC MATTRESS SYSTEMS

[75] Inventor: Yehuda Yavets-Chen, Ashdod, Israel

[73] Assignee: Medogar Technologies, Petah Tikva, Israel

[21] Appl. No.: 665,341

[22] Filed: Jun. 17, 1996

[51] Int. Cl.[6] ..... A61G 7/57

[52] U.S. Cl. ..... 5/713; 5/706; 5/188

[58] Field of Search ..... 5/710, 711, 713, 5/691, 701, 728, 188, 191, 903

[56] References Cited

U.S. PATENT DOCUMENTS

| | | | |
|---|---|---|---|
| 258,059 | 5/1882 | Hallheimer | 5/146 |
| 510,560 | 5/1992 | Uetake . | |
| 2,628,371 | 2/1953 | Null | 5/147 |
| 3,605,145 | 9/1971 | Graebe . | |
| 3,656,190 | 4/1972 | Regan et al. . | |
| 3,803,579 | 4/1974 | Compton . | |
| 3,979,740 | 9/1976 | Forbat et al. . | |
| 4,005,236 | 1/1977 | Graebe . | |
| 4,422,194 | 12/1983 | Viesturs et al. . | |
| 4,541,136 | 9/1985 | Graebe . | |
| 4,542,547 | 9/1985 | Sato . | |
| 4,614,000 | 9/1986 | Mayer . | |
| 4,617,690 | 10/1986 | Grebe . | |
| 4,662,012 | 5/1987 | Torbet . | |
| 4,722,105 | 2/1988 | Douglas . | |
| 4,750,224 | 6/1988 | Stracke . | |
| 4,777,478 | 10/1988 | Hirsch et al. . | |
| 4,799,276 | 1/1989 | Kadish . | |
| 4,827,546 | 5/1989 | Cvetkowic . | |
| 4,852,195 | 8/1989 | Schulman . | |
| 4,864,671 | 9/1989 | Evans . | |
| 4,924,211 | 5/1990 | Davies . | |
| 4,935,968 | 6/1990 | Hunt et al. | 5/713 |
| 4,944,060 | 7/1990 | Peery et al. | 5/713 |
| 4,949,412 | 8/1990 | Goode . | |
| 4,982,466 | 1/1991 | Higgins et al. . | |
| 4,989,283 | 2/1991 | Krouskop . | |
| 5,005,240 | 4/1991 | Vrzalik | 5/453 |
| 5,052,068 | 10/1991 | Graebe . | |
| 5,062,169 | 11/1991 | Kennedy et al. . | |
| 5,103,518 | 4/1992 | Gilroy et al. . | |
| 5,129,115 | 7/1992 | Higgins et al. . | |
| 5,152,023 | 10/1992 | Graebe . | |
| 5,163,196 | 11/1992 | Graebe . | |
| 5,192,304 | 3/1993 | Rassman . | |
| 5,243,721 | 9/1993 | Teasdale | 5/710 |
| 5,243,722 | 9/1993 | Gusakov . | |
| 5,267,364 | 12/1993 | Volk | 5/710 |
| 5,267,365 | 12/1993 | Walter . | |
| 5,323,500 | 6/1994 | Roe et al. | 5/710 |
| 5,369,828 | 12/1994 | Graebe . | |
| 5,373,595 | 12/1994 | Johnson et al. . | |
| 5,377,369 | 1/1995 | Shirai | 5/191 |
| 5,379,471 | 1/1995 | Holdredge . | |
| 5,388,290 | 2/1995 | Shirai | 5/188 |
| 5,542,136 | 8/1996 | Tappel | 5/710 |

FOREIGN PATENT DOCUMENTS

| | | | |
|---|---|---|---|
| 158249B | of 1990 | Denmark . | |
| 274371 | 12/1987 | European Pat. Off. | 5/188 |
| 2672196 | 8/1992 | France | 5/146 |

*Primary Examiner*—Suzanne Dino Barrett
*Assistant Examiner*—Tuyet-Phuong Pham
*Attorney, Agent, or Firm*—Scott J. Asmus; Vernon C. Maine

[57] ABSTRACT

A pneumatic mattress system includes a plurality of rigid ribs position side-by-side and hingedly interconnected so as to form a continuous overlay basis which is flexible in one direction. A plurality of pneumatic cushions is attached to each rib so as to provide a cushioned surface. The pressure of the pneumatic cushions is controlled by a main pressure control system which includes a main supply conduit with a pressurized inlet and an exhaust, both controlled by a control unit, and a pressure sensor. The pneumatic cushions are connected through a number of tubes located within the ribs to a rib control system which selectively connects them to the main supply conduit. By synchronized control of the pressure of the main supply conduit and the rib control system, the pressure within each cushion can be measured and controlled independently. The system may be used to provide a localized water-bed-type effect over zones defined in relation to a subject's body position, and to superimpose a floating hole effect for cyclic pressure release of selected areas.

14 Claims, 17 Drawing Sheets

PNUEMATIC MATTRESS SYSTEMS

FIELD AND BACKGROUND OF THE INVENTION

The present invention relates to air-filled mattresses and, in particular, it concerns a system and method employing a pneumatic mattress for the prevention and treatment of bed sores and the like.

It is known that local pressure applied to the skin disrupts the local circulatory system and can, when prolonged, lead to risk of bed sores. In healthy people, frequent body movements during even deep sleep serve to prevent prolonged application of pressure to any one site. For sick and elderly people, on the other hand, reduced mobility increases the risk of developing sores. The risks are further aggravated in people with poor circulation.

Many systems have been suggested for prevention and treatment of bed sores. One type of system employs fluid-filled cushions to distribute pressure evenly over an increased area. An example of such a system is disclosed in U.S. Pat. No. 4,949,412 to Goode. Goode discloses a closed loop feedback-controlled air supply system for air support convalescent beds. The bed is disclosed to have between 15 and 30 air cells divided along the length of the bed into five regions. Each region is maintained at a preset constant pressure value.

A similar system constructed as an overlay for a box-spring foundation is disclosed in U.S. Pat. No. 4,662,012 to Torbet. In this case, the mattress has about twenty rows of air cells divided into four zones. The cells in each zone are interconnected so as to be held at equal pressure. The overlay itself is flexible and is intended to distort as the springs give under localized pressure.

These systems have a number of major disadvantages. Firstly, they rely on a priori or manually input data in order to fix suitable pressure values. Secondly, the response of the systems is over predefined large regions, thereby precluding localized responses to specific medical conditions or body positions. Thirdly, no diagnostic information can be recovered from these systems. And finally, it is impossible to completely relieve pressure from any point of contact with the bed. The prior art overlay-type constructions suffer from the additional shortcoming that they have an inconsistent correlation between inflation pressure and body contour dependent on the properties of the underlying surface.

A second type of system uses alternate inflation and deflation of different fluid-filled support elements to cyclically relieve pressure from each point on the skin. An example of such a system is disclosed in U.S. Pat. No. 5,103,518 to Gilroy et al. Gilroy et al. disclose an alternating pressure pad as an overlay for a conventional mattress. The pad includes two sets of interspaced transverse inflatable elements which are alternately inflated and deflated. A similar system is disclosed in U.S. Pat. No. 4,852,195 to Schulman. In this case, the elements are arranged in three sets with hexagonal symmetry.

These systems also have a number of disadvantages. Firstly, the inflation pressure of all the elements is a fixed value irrespective of the part of the body being supported. Secondly, since the pressure alternates over the entire body area, discomfort may be caused to certain parts of the body which are not at risk. Thirdly, where a wound or sore already exists, the period of pressure release provided may be insufficient. And, as with the first type of system, no diagnostic information can be recovered.

There have also been attempts to produce a controllable mattress with capabilities for physical contour measurements and localized response. Examples of proposed systems of this type are disclosed in U.S. Pat. No. 4,542,547 to Sato and U.S. Pat. No. 4,799,276 to Kadish. U.S. Pat. No. 4,989,283 to Krouskop relates to a method of control for a system of this type in which the height of each cell is measured. However, these systems, if at all operable, are both over-complex and prohibitively costly to produce. Specifically, they suffer from high sensitivity to humidity and temperature leading to inaccuracy and unrepeatability of results. In addition, the use of pistons suggested by Kadish is very sensitive to transverse forces.

There is therefore a need for a pneumatic mattress providing a high resolution intelligent response to local pressure maxima, allowing complete relief of contact pressure from critical areas of the body, and generating useful diagnostic information. It would also be highly advantageous to provide a low-cost versatile pneumatic mattress system for use as part of a bed or as an overlay which is capable of providing a wide range of diagnostic, preventative and therapeutic functions.

SUMMARY OF THE INVENTION

The present invention is of a pneumatic mattress system for measuring, controlling and optimizing the profile of body contact pressure between a subject and the mattress.

According to the teachings of the present invention there is provided, a pneumatic bed overlay comprising: (a) a plurality of rigid ribs positioned side-by-side and hingedly interconnected so as to form a continuous overlay basis which is flexible in one direction; and (b) a plurality of pneumatic cushions attached to each of the rigid ribs so as to provide a cushioned surface.

According to a further feature of the present invention, the plurality of rigid ribs are hingedly interconnected so as to allow relative rotation between adjacent ribs of at least about ±30°.

According to a further feature of the present invention, the plurality of rigid ribs are hingedly interconnected so as to allow relative rotation between adjacent ribs of up to about ±60°.

According to a further feature of the present invention, the plurality of rigid ribs includes at least about twenty rigid ribs.

According to a further feature of the present invention, the plurality of pneumatic cushions attached to each of the rigid ribs includes at least about seven cushions.

According to a further feature of the present invention, the plurality of rigid ribs are hingedly interconnected by a plurality of ribbons interlaced between the rigid ribs.

According to a further feature of the present invention, each of the rigid ribs has a substantially flattened hexagonal cross-section.

According to a further feature of the present invention, there are also provided a plurality of tubes mounted within each of the rigid ribs, each of the tubes communicating pneumatically with at least one of the pneumatic cushions.

According to a further feature of the present invention, there are also provided: (a) a main pressure control system including: (i) a main supply conduit, (ii) a valve-controlled pressurized inlet to the main supply conduit, (iii) a valve-controlled exhaust from the main supply conduit, and (iv) a control unit for controlling the inlet and the exhaust; and (b) a rib control system associated with each of the ribs for selectively connecting between the main supply conduit and each of the tubes.

According to a further feature of the present invention, the rib control system includes a microprocessor, the microprocessor being electrically connected to the control unit.

There is also provided according to the teachings of the present invention, a pneumatic mattress system comprising: (a) a plurality of pneumatic cushions deployed so as to form a substantially continuous surface over at least a region of the mattress; (b) a plurality of tubes, each of the tubes communicating pneumatically with at least one of the pneumatic cushions; and (c) a main pressure control system including: (i) a main supply conduit, (ii) a valve-controlled pressurized inlet to the main supply conduit, (iii) a valve-controlled exhaust from the main supply conduit, (iv) a plurality of local valves for selectively connecting between the main supply conduit and each of the tubes, and (v) a control unit for controlling the inlet, the exhaust and the local valves so as to control each of the pneumatic cushions substantially individually.

According to a further feature of the present invention, a majority of the pneumatic cushions each corresponds to an area of not more than about 0.01 square meters.

According to a further feature of the present invention, there is also provided a pressure sensor associated with the main pressure control system for measuring pressure in the main supply conduit such that, when one of the local valves is open while the inlet and the exhaust are closed, the pressure sensor measures the pressure in a corresponding one of the pneumatic cushions.

According to a further feature of the present invention, the control unit includes a memory for storing information relating to pressures within the pneumatic cushions.

According to a further feature of the present invention, the control unit further includes a processor for processing the information relating to pressures within the pneumatic cushions so as to determine a preferred direction of pressure change for at least some of the pneumatic cushions.

According to a further feature of the present invention, there is also provided an output device for outputting the stored information relating to pressures within the pneumatic cushions.

According to one implementation of the present invention, the pneumatic mattress system is intended for use as an overlay for a conventional bed, and includes a plurality of rigid ribs positioned side-by-side and hingedly interconnected so as to form a continuous overlay basis which is flexible in one direction, and wherein a number of the plurality of pneumatic cushions is attached to each of the rigid ribs so as to provide a cushioned surface.

According to an alternative implementation of the present invention, there is also provided: (a) a rigid board having an upper surface, the plurality of pneumatic cushions being mounted on the upper surface; and (b) a cut-out mattress having a top surface and an opening for receiving the rigid board such that the top surface and the plurality of pneumatic cushions form a substantially continuous bed surface.

There is also provided, according to the teachings of the present invention, a method of controlling a pneumatic mattress having a plurality of independently controllable pneumatic cushions with a subject lying thereon, the method comprising the steps of: (a) measuring cushion pressures within at least some of the cushions; (b) identifying a number of the cushions which correspond to local maxima of the measured cushion pressures as peak cushions; (c) defining a plurality of working regions, each of the working regions being made up of a plurality of the pneumatic cushions and including at least one of the peak cushions; and (d) for each of the working regions, adjusting the pressure within at least some of the pneumatic cushions within that working region so as to approach equalization of cushion pressures within the pneumatic cushions of that working region.

According to a further feature of the present invention, there is also provided the step of, after identifying the peak cushions, comparing the measured cushion pressure of each of the peak cushions with the measured cushion pressures of proximal cushions to identify untreatable peak cushions, and wherein the working regions are defined to exclude any cushions identified as untreatable peak cushions.

According to a further feature of the present invention, the step of adjusting the pressure is performed using a cell of known volume having selectively sealable pneumatic communication with each of the plurality of cushions and to the atmosphere, the step including the sub-steps of: (i) identifying one of the cushions as a current cushion requiring a reduction in cushion pressure; (ii) opening pneumatic communication between the cell and the atmosphere so as to bring the pressure within the internal volume of the cell to ambient atmospheric pressure; (iii) closing pneumatic communication between the cell and the atmosphere; (iv) opening pneumatic communication between the cell and the current cushion to allow equalization of pressure therebetween; (v) closing pneumatic communication between the cell and the current cushion; and (vi) measuring the pressure within the cell.

According to a further feature of the present invention, the step of adjusting the pressure is performed using a volume cell having a high surface area and made from a material having high thermal conductivity.

According to a further feature of the present invention, there is also provided a step of calculating the present height of the current cushion, the step of calculating including calculation of the quantity of air removed from the current cushion based on the known volume and measured pressure of the volume cell.

According to a further feature of the present invention, there are also provided the steps of: (a) subsequent to the step of adjusting the pressure, measuring the adjusted cushion pressures of the pneumatic cushions; and (b) calculating, based on the adjusted cushion pressures, a measure of the weight of the subject.

According to a further feature of the present invention, a reset step is performed intermittently, the reset step including raising all of the pneumatic cushions to a pressure sufficient to inflate each of the pneumatic cushions to substantially its maximum volume while the subject is lying thereon.

According to a further feature of the present invention, there are also provided, subsequent to the step of adjusting the pressure, the steps of: (a) temporarily reducing cushion pressure within a selected one of the pneumatic cushions within at least one of the working regions; (b) returning cushion pressure within the selected cushion to its previous adjusted pressure; and (c) repeating steps (a) and (b) for a sequence of the pneumatic cushions so as to provide intermittent pressure release to the skin of the subject in the corresponding areas.

According to a further feature of the present invention, there are also provided the steps of: (a) inputting data relating to a critical area defined on the body of the subject; (b) analyzing the measured cushion pressures to derive information relating to the current position of the subject on the pneumatic mattress; (c) identifying at least one pneumatic cushion as a critical cushion corresponding to a current area of contact of the critical area of the subject's body; and (d) lowering the cushion pressure within the at least one critical cushion.

There is also provided according to the teachings of the present invention, a method of precise control for a pneumatic mattress having a plurality of independently controllable pneumatic cushions with a subject lying thereon, the method comprising the steps of: (a) providing a cell of known volume having selectively sealable pneumatic communication with each of the pneumatic cushions, with a pressure source and to the atmosphere; (b) determining a desired direction of pressure change for a number of the pneumatic cushions; (c) for each of the pneumatic cushions which is to have its pressure reduced (referred to individually as a reducing cushion): (i) opening pneumatic communication between the cell and the atmosphere so as to bring the pressure within the internal volume of the cell to ambient atmospheric pressure, (ii) closing pneumatic communication between the cell and the atmosphere, (iii) opening pneumatic communication between the cell and the reducing cushion to allow equalization of pressure therebetween, (iv) closing pneumatic communication between the cell and the reducing cushion, and (v) measuring the pressure within the cell; and (d) for each pneumatic cushion which is to have its pressure increased (referred to individually as an increasing cushion): (i) opening pneumatic communication between the cell and the pressure source so as to bring the pressure within the internal volume of the cell to a known elevated pressure, (ii) closing pneumatic communication between the cell and the pressure source, (iii) opening pneumatic communication between the cell and the increasing cushion to allow equalization of pressure therebetween, (iv) closing pneumatic communication between the cell and the increasing cushion, and (v) measuring the pressure within the cell.

According to a further feature of the present invention, the volume cell has a high surface area and is made from a material having high thermal conductivity.

According to a further feature of the present invention, a reset step is performed intermittently, the reset step including raising all of the pneumatic cushions to a pressure sufficient to inflate each of the pneumatic cushions to substantially its maximum volume while the subject is lying thereon.

According to a further feature of the present invention, there is also provided a step of calculating the present height of a plurality of the pneumatic cushions, the step of calculating including calculation of the quantity of air removed from, or added to, each pneumatic cushion based on the known volume and measured pressures of the volume cell.

There is also provided, according to the teachings of the present invention, a method for assessment of a risk factor of developing contact-pressure related ailments for a subject lying on a pneumatic mattress which includes a plurality of pneumatic cushions, the method comprising the steps of: (a) performing a first measurement of the pressure within each of the pneumatic cushions, the pressures measured being referred to herein as "current pressures"; (b) performing a subsequent measurement of the pressure within each of the pneumatic cushions, the pressures measured being referred to herein as "subsequent pressures"; (c) comparing the subsequent pressures with the current pressures to determine whether the subject has shifted his body position significantly; (d) if the subject has shifted significantly, recording the time of the subsequent measurement as a position shift time and redefining the current pressures to equal the subsequent pressures; (e) returning to step (b) repeatedly until sufficient data has been recorded; and (f) processing at least the recorded position shift times to generate a risk factor.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is of a pneumatic mattress system, and a corresponding method, for measuring, controlling and optimizing the profile of body contact pressure between a subject and the mattress.

The principles and operation of the system and method according to the present invention may be better understood with reference to the drawings and the accompanying description.

Generally speaking, the pneumatic mattress system of the present invention provides a structurally simple construction employing a layer of small closely-spaced individually-controllable pneumatic cushions to allow precise measurement and optimal adjustment of the contact pressure between the mattress and a subject lying on the mattress.

The present invention will be illustrated with reference to three embodiments. Firstly, with reference to FIGS. 1–7, an embodiment suitable for use as an overlay for a conventional bed will be described. Secondly, an embodiment integrally formed as part of a bed will be described with reference to FIG. 8. And thirdly, with reference to FIG. 9, an embodiment having a reduced functional area suitable for treatment of specific localized conditions will be described. The pressure control system and various modes of operation of the present invention which are similar for each of the embodiments will then be described with reference to FIGS. 10–12.

Figure 1:
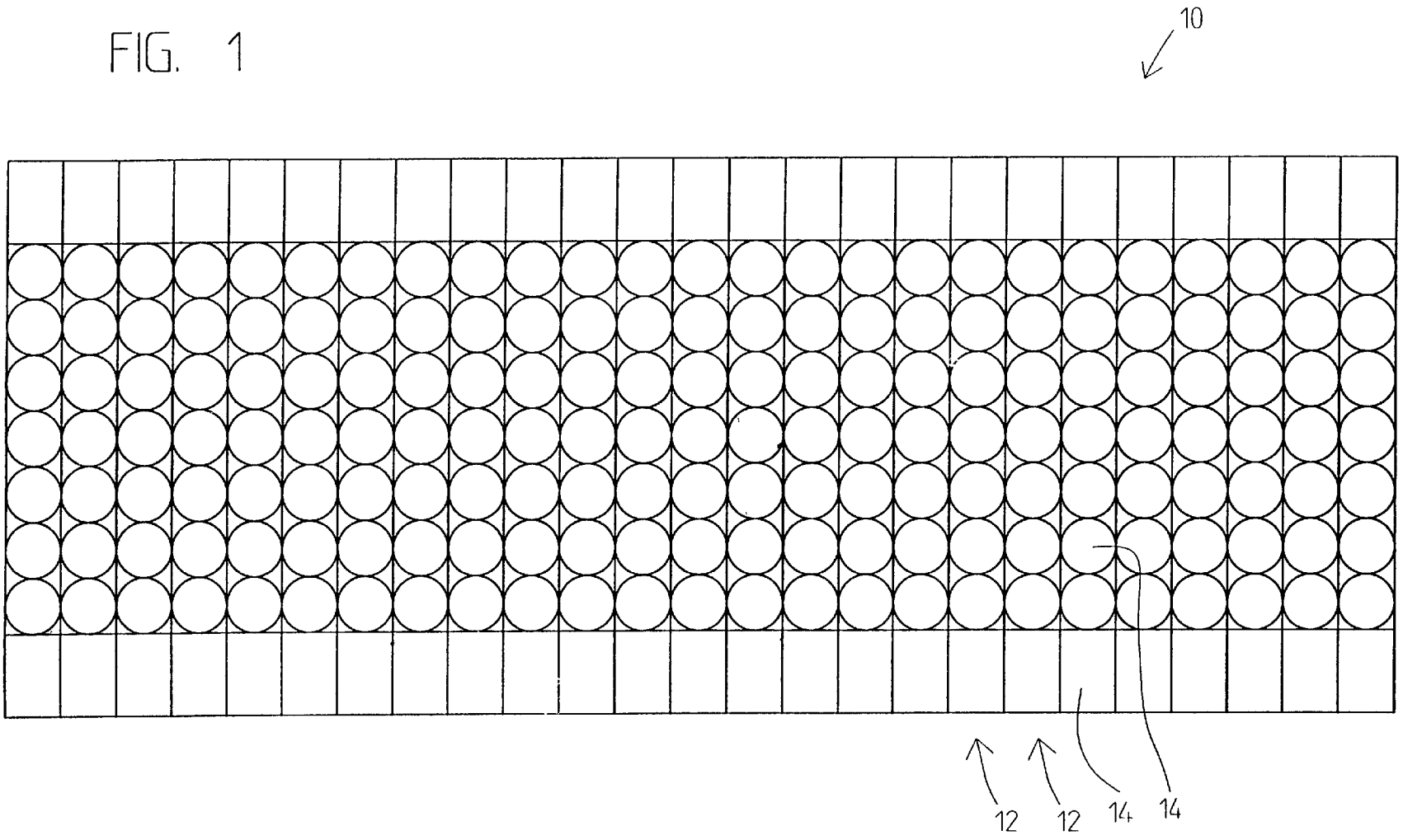
FIG. 1 is a schematic plan view of a first embodiment of a pneumatic mattress system, constructed and operative according to the teachings of the present invention, including a plurality of ribs.
Figure 2:
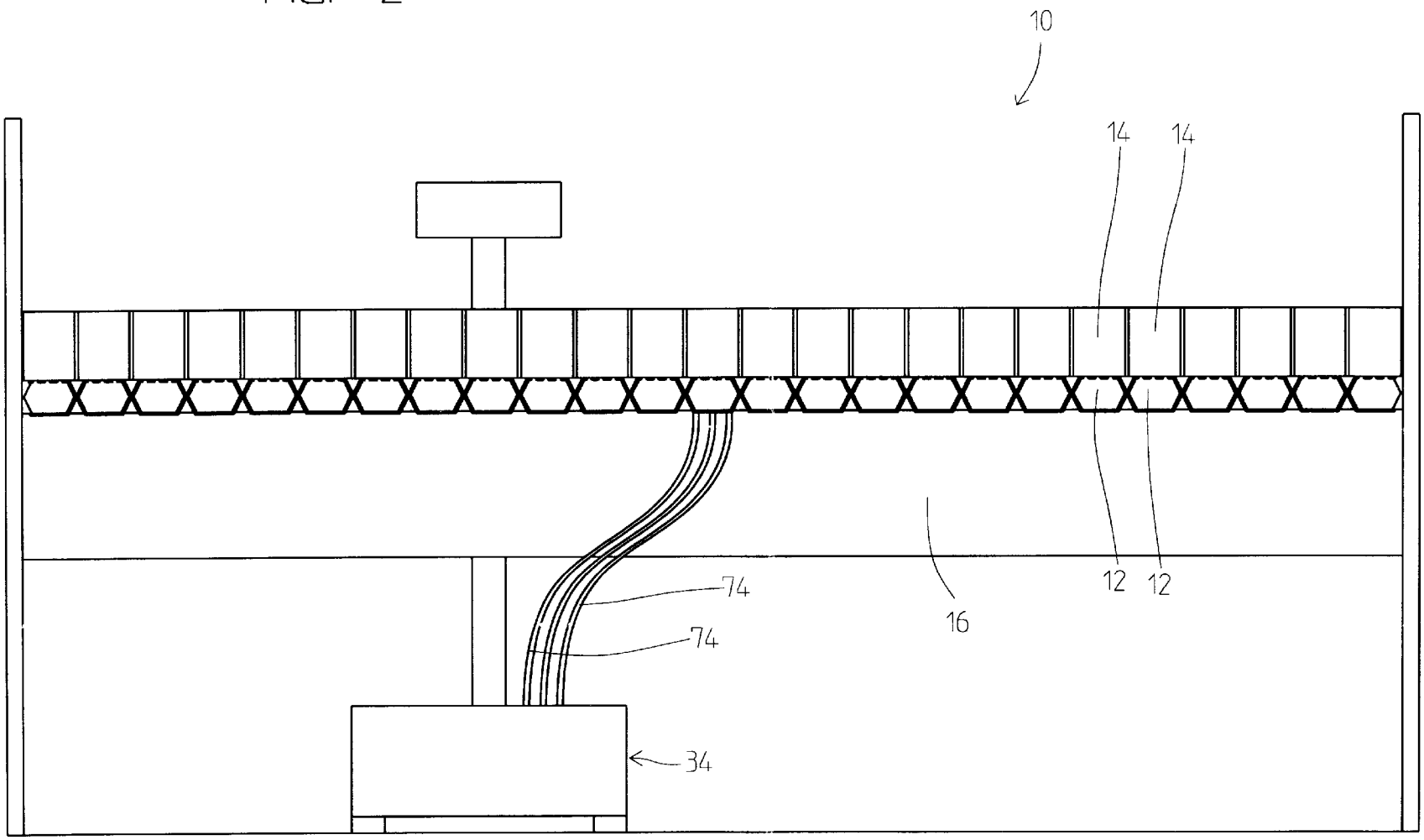
FIG. 2 is a schematic side view of the embodiment of FIG. 1.

Referring now to the drawings, FIGS. 1 and 2 show a first embodiment of a pneumatic mattress system, generally designated 10, constructed and operative according to the teachings of the present invention.

In general terms, pneumatic mattress system 10, referred to interchangeably as pneumatic bed overlay 10, includes a number of rigid ribs 12 positioned side-by-side and hingedly interconnected so as to form a continuous overlay basis which is flexible in one direction. Pneumatic bed overlay 10 also includes a plurality of pneumatic cushions 14 attached to each rigid rib 12 so as to provide a cushioned surface. The flexibility of the overlay basis allows pneumatic bed overlay 10 to conform to the shape of a conventional articulated hospital bed 16 on which it is placed while providing the rigid base required for proper functioning of pneumatic cushions 14, as will be described below.

It is an important feature of preferred embodiments of the present invention that the pneumatic mattress systems of the present invention allow precise measurement and control of the pressure across the pneumatic mattress at a high spatial resolution. Full details of the main pressure control system, as well as various modes of operation which may be achieved therewith, will be presented below with reference to FIGS. 10–12. At this stage, however, the description will be limited to structural features inherent to the design of ribs 12.

Figure 3:
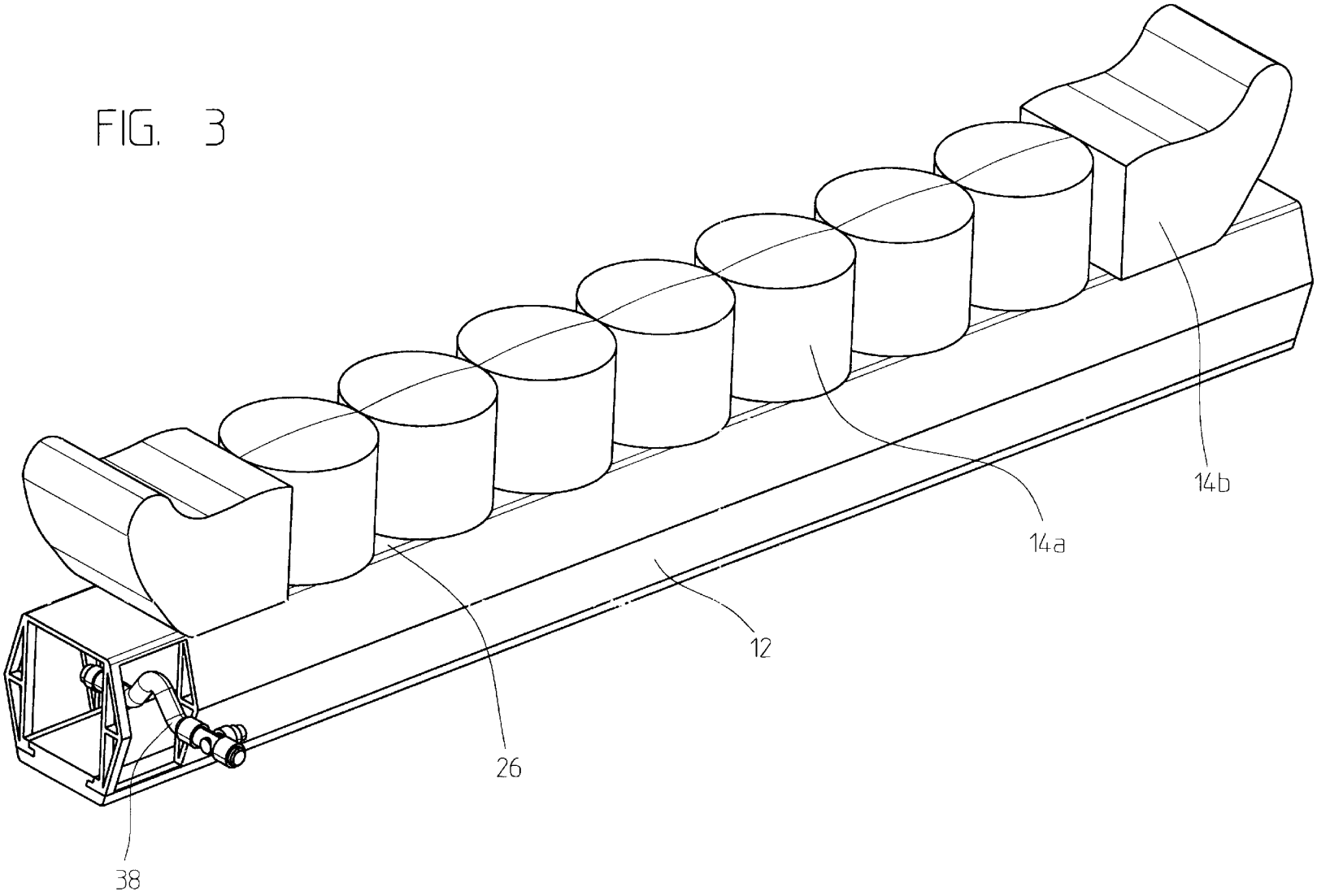
FIG. 3 is a perspective view of a rib from the embodiment of FIG. 1.
Figure 4:
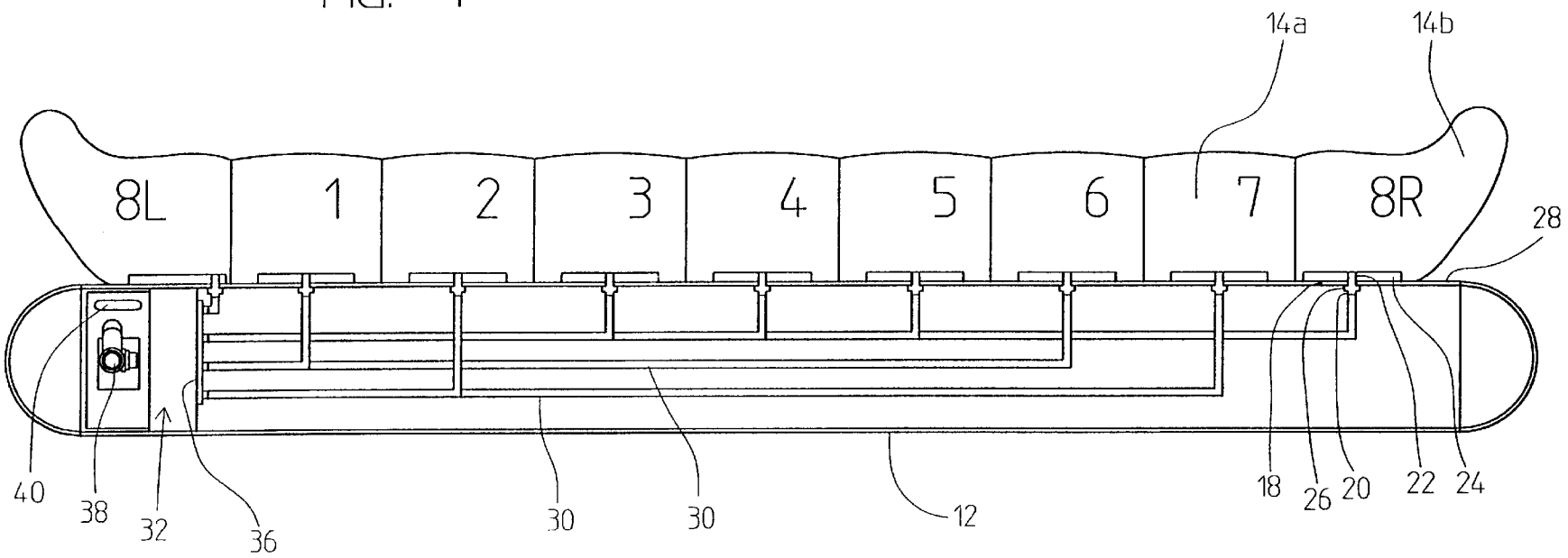
FIG. 4 is a cross-sectional view taken along the length of the rib of FIG. 3.

Turning now to the features of pneumatic bed overlay 10 in more detail, FIGS. 3 and 4 show a rib 12 with its associated pneumatic cushions 14. In certain circumstances in which the design of the underlying bed is known, the number of ribs used may be reduced to as few as four or five. In this case, multiple rows of pneumatic cushions 14 are attached to each rib 12. In general, however, it is preferable to provide at least about twenty ribs 12, thereby ensuring compatibility with any bed design which may be encountered. In the latter case, each rib typically supports a single row of pneumatic cushions, as shown. Along its length, i.e., to the width of the bed, rib 12 preferably supports at least about seven, and typically about nine, pneumatic cushions 14. Each pneumatic cushion 14 is made from tough flexible air-tight material, and typically of PVC or other similar polymer material.

Pneumatic cushions 14 are preferably of two types: standard cushions denoted 14*a*, and edge cushions denoted 14*b*. Standard cushions 14*a* are shown here as cylindrical when inflated, but may alternatively have a rectangular or hexagonal horizontal section. Preferably, each standard cushion 14*a* has a horizontal area of no more than about 0.01 square meters. In the case of cylindrical cushions as shown, typical dimensions are about 8 cm diameter and at least about 9 cm vertical height. Edge cushions 14*b* are slightly larger than standard cushions 14*a*, and are shaped to provide additional support to prevent a subject from rolling over the edge of pneumatic bed overlay 10.

Each pneumatic cushion 14 features an opening 18 in its lower surface through which air is supplied to and from the cushion. Air-tight connection to opening 18 is achieved by a combination of a low-profile threaded connector 20 engaged within a threaded bore 22 in an attachment plate 24 positioned within pneumatic cushion 14. Connector 20 preferably also features a flange 26 so that, when connector 20 is positioned below the upper surface 28 of rib 12 extending through an aperture in the rib surface and engaged within threaded bore 22, tightening of connector 20 serves to clamp pneumatic cushion 14 against upper surface 28 of rib 12.

Each pneumatic cushion 14 is connected via a tube 30 to a rib control system 32. Generally, each pneumatic cushion 14 is supplied by a unique tube 30 to allow completely independent control of cushion pressure. However, in specific cases in which it is very unlikely that a subject will be lying on two particular cushions simultaneously, those cushions may share a single tube 30. This is typically the case with opposite edge cushions 14*b*.

Typically, the length of tubes 30 vary according to the position of the corresponding pneumatic cushions 14 along rib 12. Since the volume contained within each tube 30 interconnects with the volume of the corresponding pneumatic cushion 14, this variation in length causes a variation in the effective volume of pneumatic cushions 14. This variation is corrected for by calibration of the system, as will be described below. Alternatively, tubes 30 may all be of equal length with any excess length of tube being coiled or folded within rib 12. The volume of tubes 30 may then be neglected.

Control of the pressure within each pneumatic cushion 14 is achieved by coordination of rib control system 32 with a main pressure control system 34 (FIG. 2). Rib control system 32 features a multiple-valve solenoid-controlled distributor 36 for selectively connecting between a main supply conduit 38 and zero, one or more of tubes 30. Distributor 36 is typically actuated by a simple local microprocessor 40 provided for this purpose. The structural details and functionality of main pressure control system 34 will be described at length below.

Figure 5A:
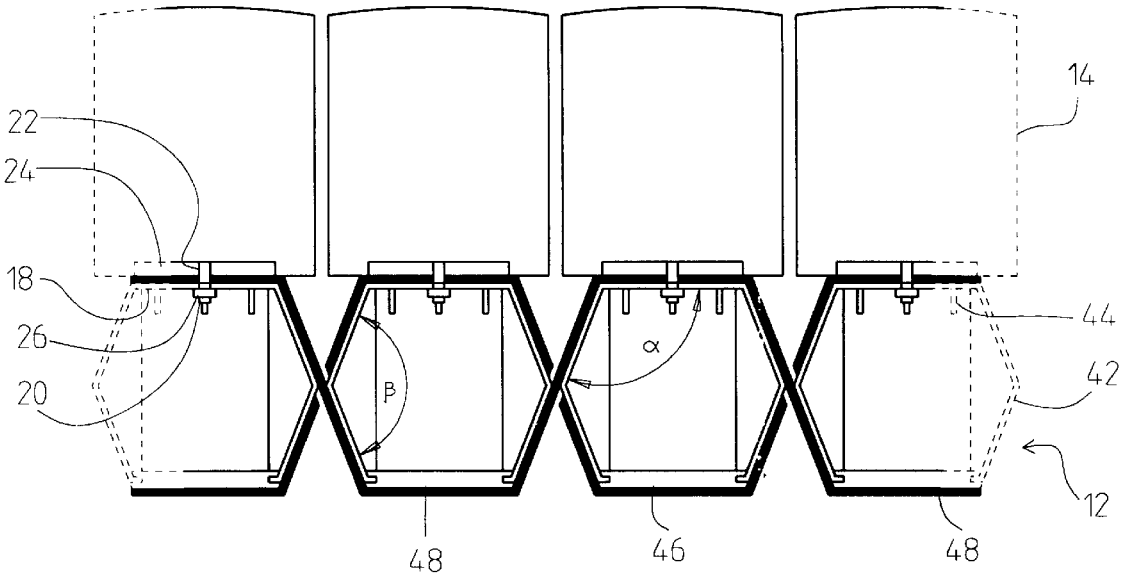
FIG. 5A is a side cross-sectional view of a number of ribs from the embodiment of FIG. 1 illustrating a preferred method of interconnection of the ribs.
Figure 5B:
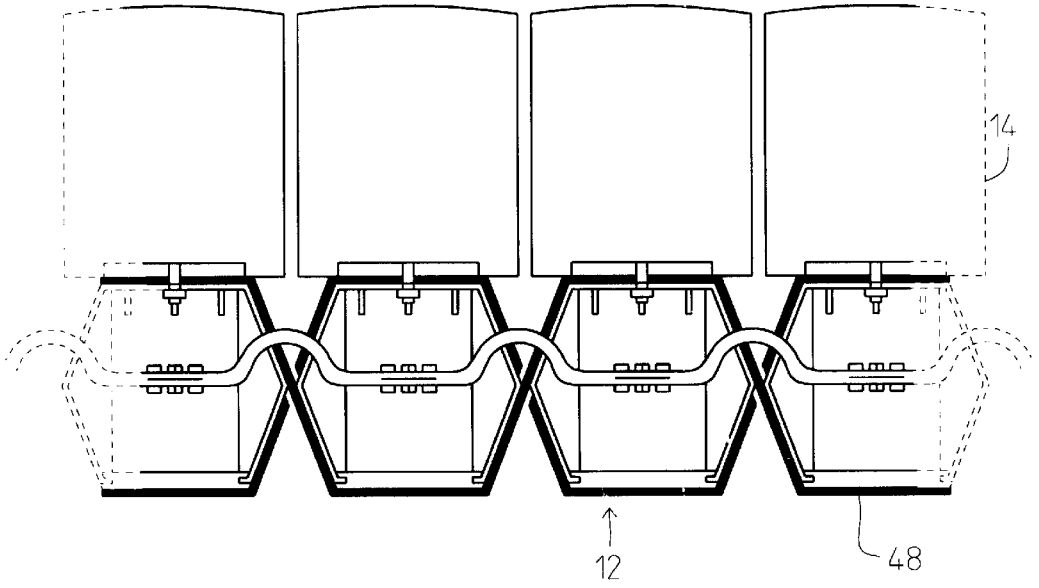
FIG. 5B is a side cross-sectional view similar to FIG. 5A taken near the end of the ribs.

The structure and interconnection of ribs 12 will now be described with reference to FIGS. 5A and 5B. Each rib 12 is formed from an upper casing 42 reinforced with a number of elongated fins 44 and closed by a detachable backpiece 46. The hollow space within upper casing 42 is utilized for tubes 30, as described above. Ribs 12 are made sufficiently strong and rigid to support the majority of the weight of a person without breaking and without significant bending. Suitable materials for ribs 12 include, but are not limited to, various metals or metal alloys and lightweight polymer resin materials.

It is an important feature of the bed overlay of the present invention that ribs 12 are hingedly interconnected in such a way as to prevent any significant translational displacement of adjacent ribs. The combination of this type of hinging with the strength and rigidity of ribs 12 ensures that upper surface 28 provides a reliable zero-pressure-level base for pneumatic cushions 14, thereby allowing accurate calculation of cushion pressures and heights as will be explained below. At the same time, the ability of adjacent ribs 12 to rotate relative to each other through at least about ±30°, and preferably through up to about ±60°, allows pneumatic bed overlay 10 to be used to overlay all types of conventional adjustable and articulated hospital beds.

The required hinged interconnection of ribs 12 may be provided by arrangements of hinges or double-hinges of various designs. However, in order to reduce the cost and weight of the system, a preferred embodiment of pneumatic bed overlay 10 employs an arrangement of interlaced ribbons 48.

In order to make the use of interlaced ribbons 48 effective, ribs 12 preferably have a substantially flattened-hexagonal cross-section. In this context, it should be understood that the term "hexagonal" does not necessarily imply equal-angled. In fact, the choice of angles results from balancing two opposing considerations. Denoting the angle between upper surface 28 and the adjacent upward-facing section of the projecting lip as $\alpha$, and the angle formed between the two faces of the projecting lip as $\beta$, it will be understood by simple geometry that $2\alpha+\beta=360°$. On one hand, the need for a near-continuous upper surface as the basis for pneumatic cushions 14 suggests that the projecting lips of ribs 12 should not extend far beyond the edges of upper surface 28, i.e., $\{\alpha\rightarrow 90°:\beta\rightarrow 180°\}$. On the other hand, the maximum rotation possible between adjacent ribs 12 is limited to $180°-\beta$ such that $\alpha\approx\beta\approx 120°$ would allow optimal rotational freedom of up to about ±60°. In practice, it is desirable to have a freedom of rotation of at least about 30° $\{\alpha\approx 105°:\beta\approx 150°\}$, and preferably nearer to ±60° $\{\alpha\approx\beta\approx 120°\}$.

It should also be noted that the preferred cross-section of ribs 12 is described as substantially flattened-hexagonal in as much as it has at least five sides lying in an approximately flattened-hexagonal formation. The specific shape of, or even the inclusion of, a sixth (lower) side is not critical to the functionality of ribs 12.

Figure 6:
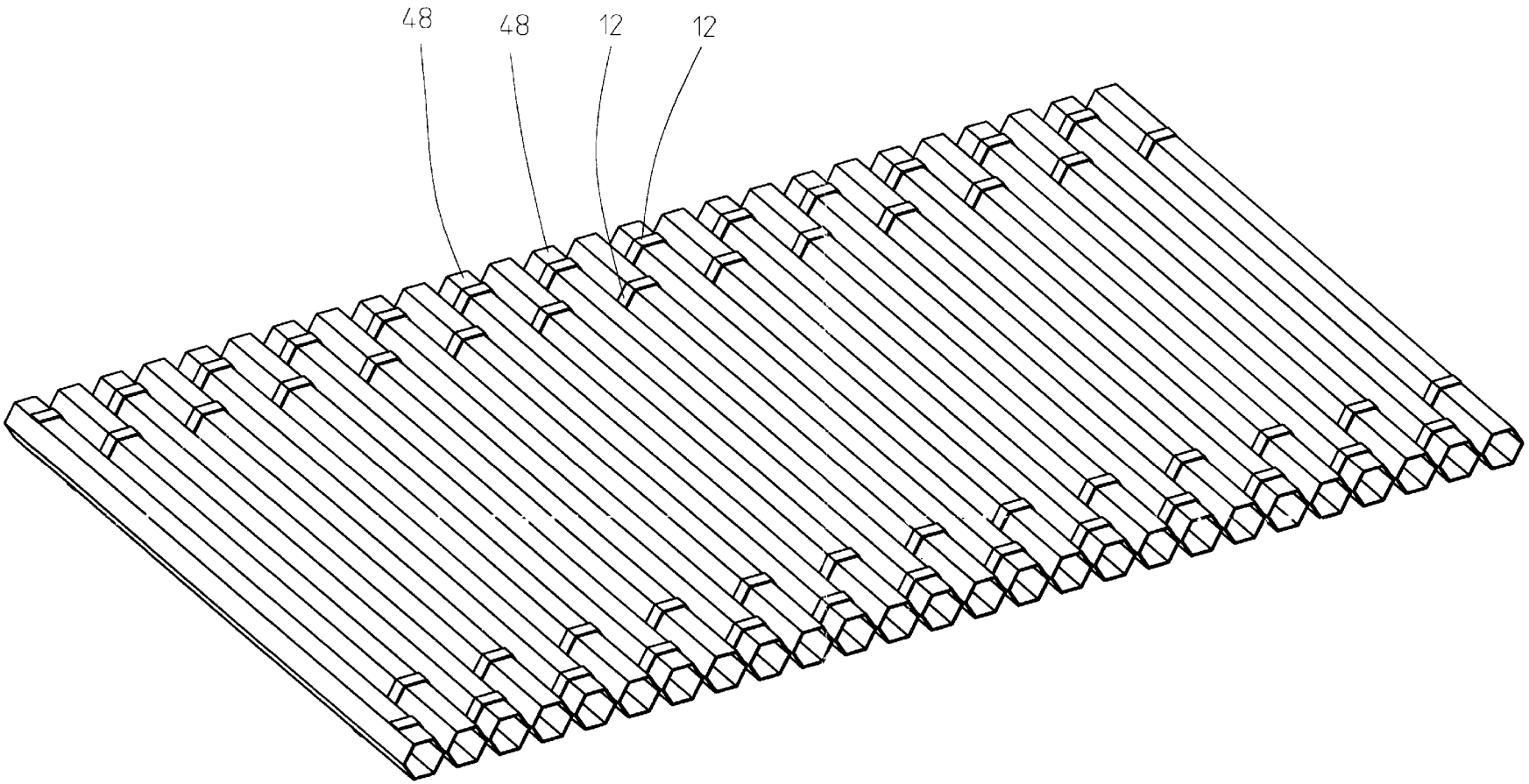
FIG 6 is a horizontal cross-sectional view through the embodiment of FIG. 1 showing the interconnection of the ribs corresponding to FIG. 5.

Ribbons 48 are flat straps of substantially non-stretchable flexible material of any suitable type. At least two ribbons 48 are employed alternately interweaving between adjacent ribs 12 near their ends. FIG. 6 illustrates a typical positioning of ribbons 48.

Figure 7:
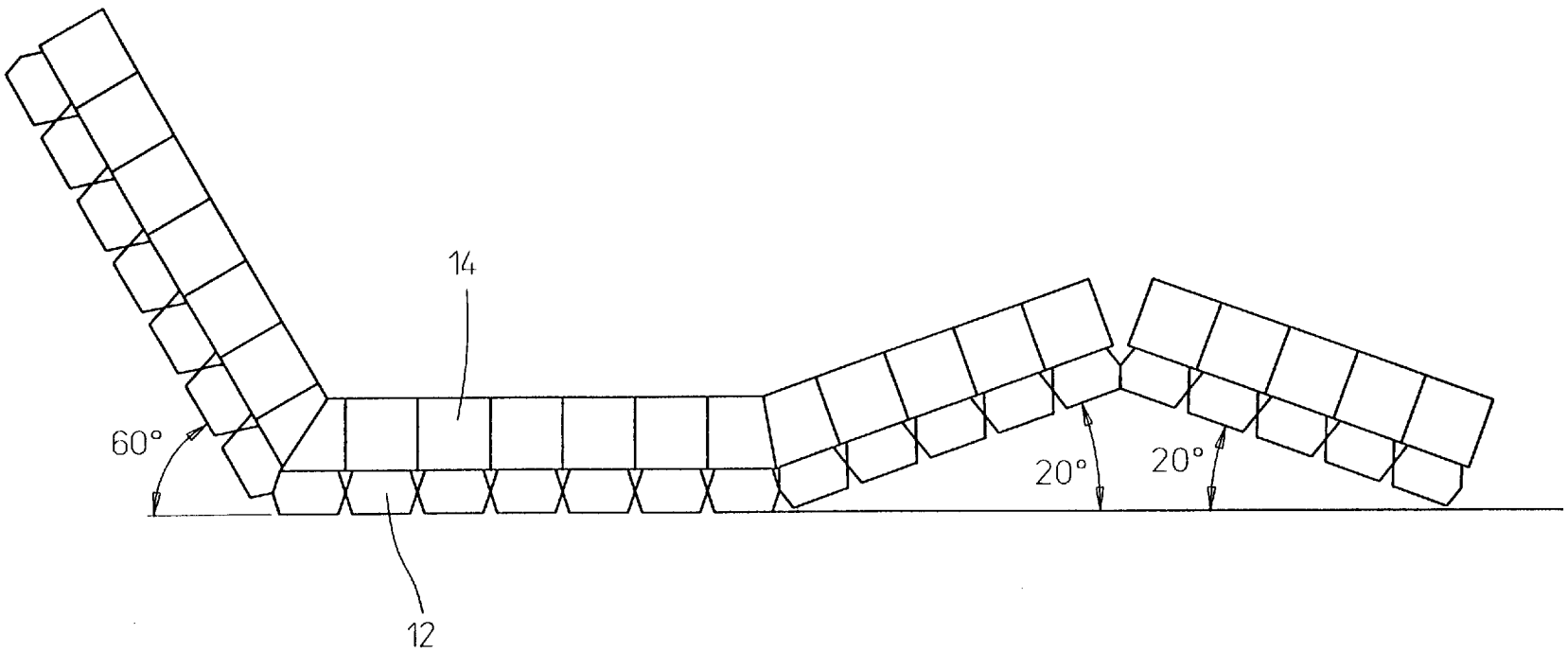
FIG. 7 is a schematic side view of the embodiment of FIG. 1 used as an overlay over a conventional articulated bed.

Referring now briefly to FIG. 7, this illustrates the manner in which pneumatic bed overlay 10 takes on the shape of the bed over which it is placed. It should be appreciated that this flexibility is in one direction only, i.e., allowing bending or pivoting along lines parallel to the width of the bed, while remaining rigid against all other types of rotation, skewing and translation.

Figure 8:
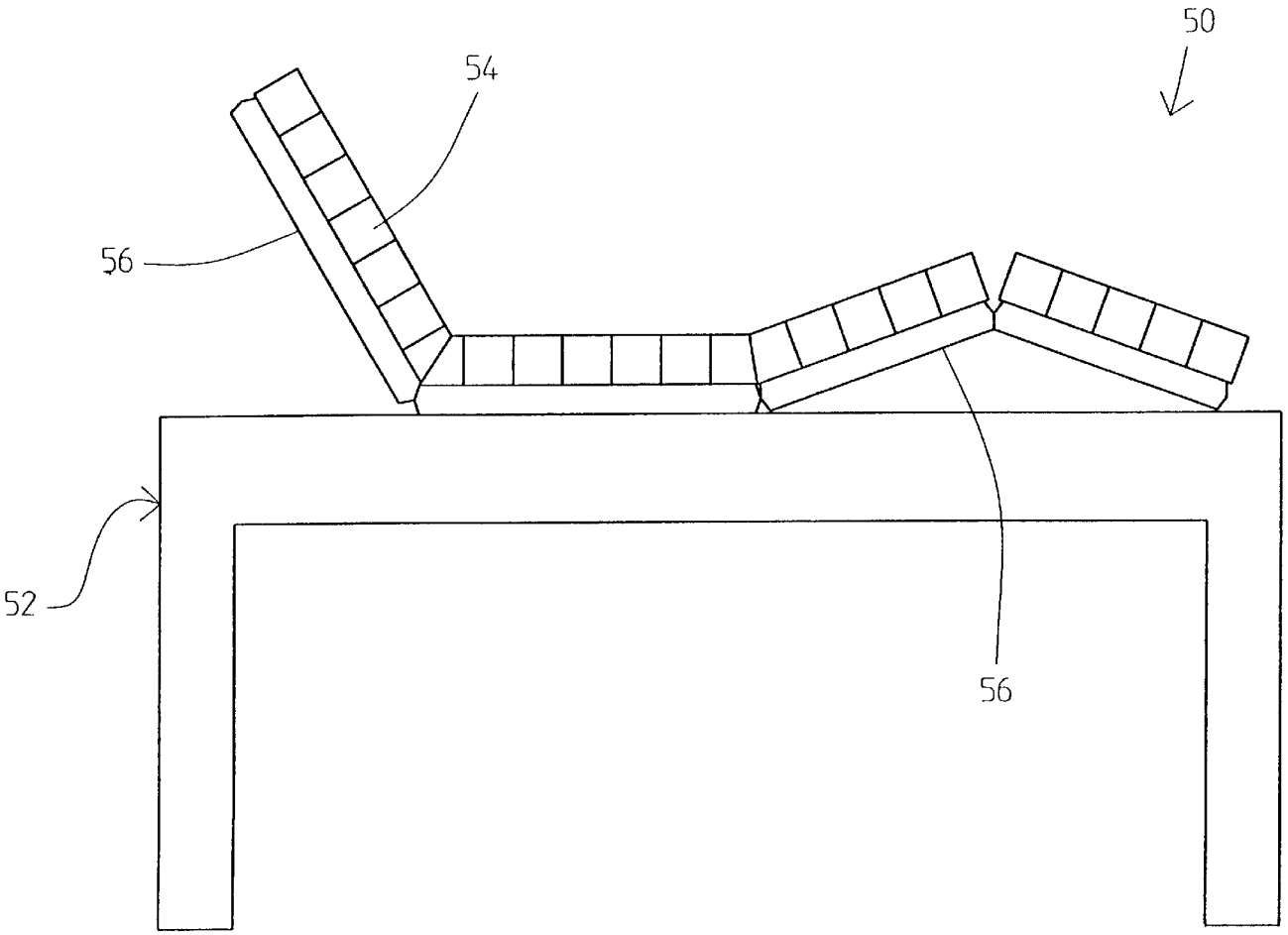
FIG. 8 is a schematic side view of a second embodiment of a pneumatic mattress system, constructed and operative according to the teachings of the present invention, integrally formed as part of a bed.

Turning now to a second embodiment of the pneumatic mattress system of the present invention, this will be described with reference to FIG. 8. FIG. 8 shows a pneumatic mattress system, generally designated 50, constructed and operative according to the teachings of the present invention, integrally formed as part of a bed 52. Pneumatic mattress system 50 includes a plurality of pneumatic cushions 54, similar to pneumatic cushions 14, attached to a number of rigid support elements 56 of bed 52. The detailed structure of pneumatic mattress system 50 will be understood fully by one ordinarily skilled in the art by analogy with the description of pneumatic mattress system 10, above.

Figure 9:
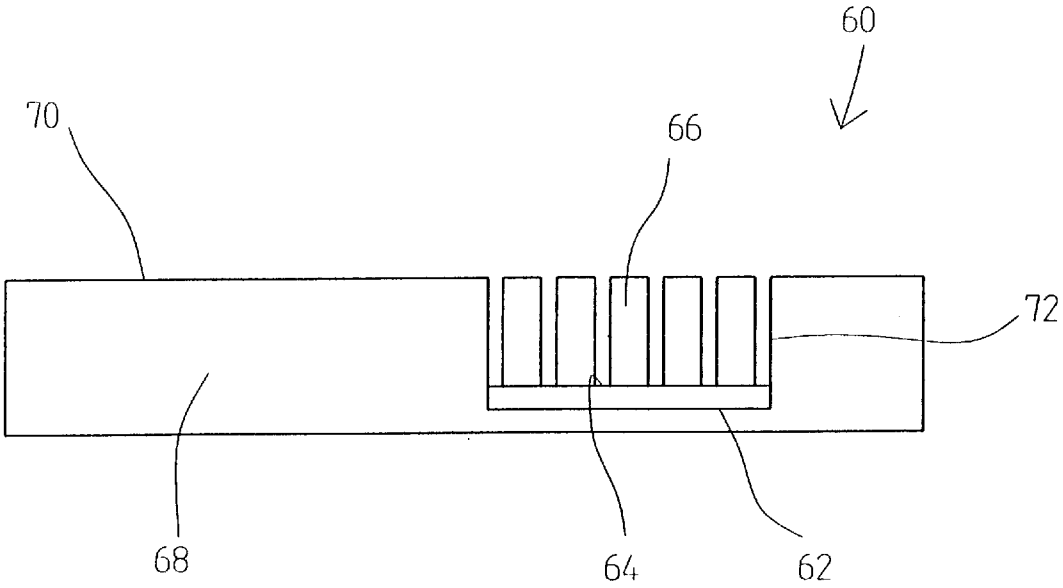
FIG. 9 is a schematic side view of a third embodiment of a pneumatic mattress system, constructed and operative according to the teachings of the present invention, in which a reduced area is pneumatically controlled.

Turning now to a third embodiment of the pneumatic mattress system of the present invention, this will be described with reference to FIG. 9. FIG. 9 shows a pneumatic mattress system, generally designated 60, constructed and operative according to the teachings of the present invention. Pneumatic mattress system 60 includes a rigid board 62 having an upper surface 64, and a plurality of pneumatic cushions 66 mounted thereon. Pneumatic mattress system 60 also features a cut-out mattress 68 having a top surface 70 and an opening 72 for receiving rigid board 62. Top surface 70 and pneumatic cushions 66 are arranged to form a substantially continuous bed surface.

Pneumatic mattress system 60 is particularly suited to specific cases in which only one part of the body is particularly susceptible to, or affected by, some condition, and offers a particularly low-cost, practical option for home use of the systems of the present invention, when required. The detailed structure of pneumatic mattress system 60 will be understood fully by one ordinarily skilled in the art by analogy with the description of pneumatic mattress system 10, above.

Figure 10:
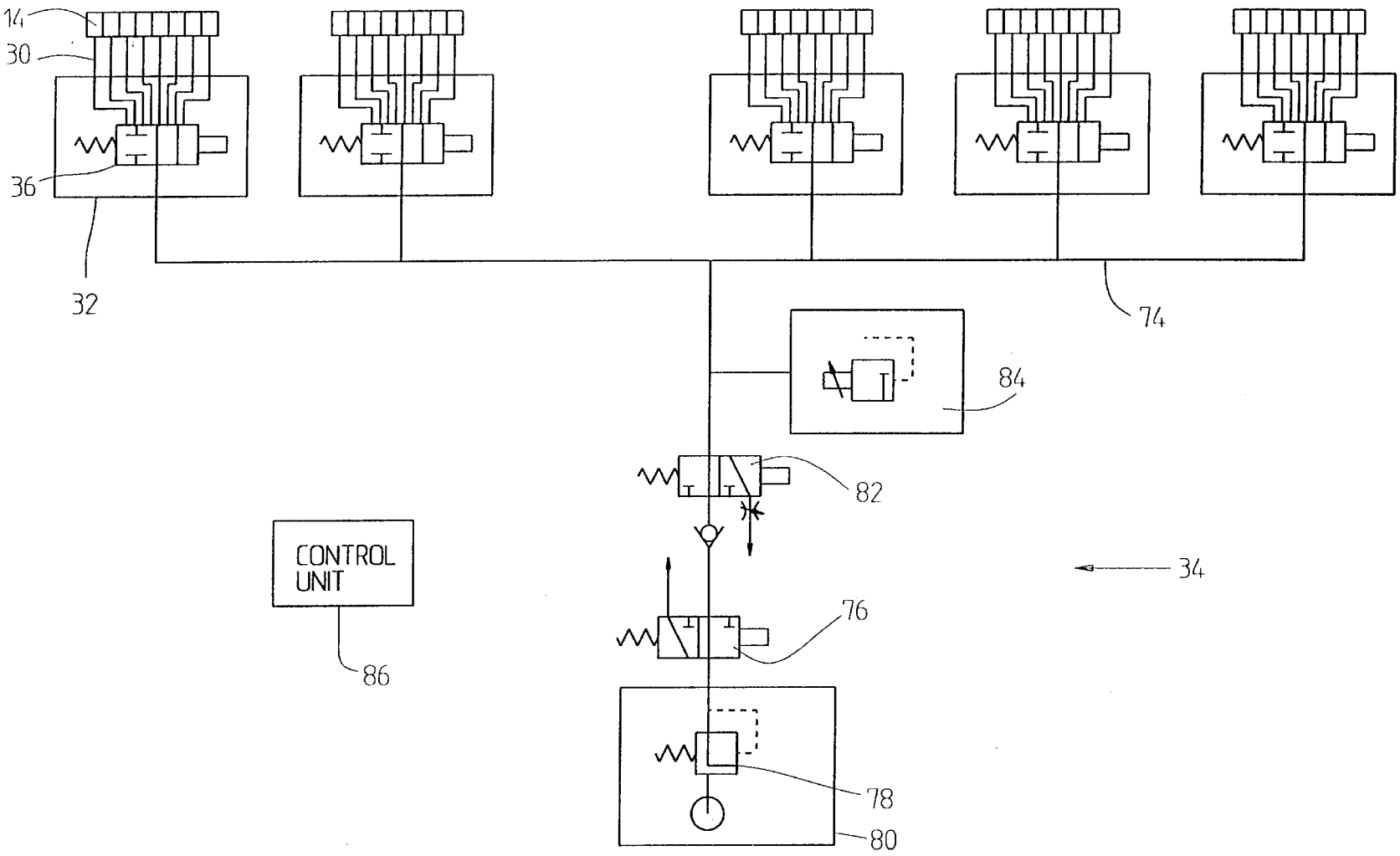
FIG. 10 is a block diagram illustrating the structure of a pressure control system for use in a pneumatic mattress system according to the present invention.

Turning now to the structure of main pressure control system 34, this is illustrated in FIG. 10. Main pressure control system 34 features a main supply conduit 74 which is connected through an inlet valve 76 to the regulator 78 of a compressor 80. Main supply conduit 74 also features an exhaust valve 82 for releasing pressure to the atmosphere, and a pressure sensor 84 which continuously senses the pressure within main supply conduit 74. Main supply conduit 74 extends along the pneumatic mattress assembly at the end of ribs 12 as shown in FIG. 5B, connecting with each rib control system 32.

A control unit 86 is in electrical communication with inlet valve 76, exhaust valve 82, pressure sensor 84 and each rib control system 32. For the purpose of clarity, the electrical connections are not shown in the Figure. Control unit 86 controls inlet valve 76 and exhaust valve 82, and coordinates their operation with that of rib control systems 32.

By controlling the state of inlet valve 76 and exhaust valve 82, control unit 86 sets main supply conduit 74 to one of three states. When inlet valve 76 is open and exhaust valve 82 is closed, main supply conduit 74 becomes a pressure source for supplying of pneumatic cushions. When both inlet valve 76 and exhaust valve 82 are closed, main supply conduit 74 assumes a passive pressure-measuring state. And when inlet valve 76 is closed and exhaust valve 82 is open, main supply conduit 74 allows release of pressure to the atmosphere.

As described earlier, each rib control system 32 features a distributor 36 which connects selectively between main supply conduit 74 and any combination of tubes 30. It follows that, by suitable selection of the state of main supply conduit 74 synchronized with opening of selected valves of one or more distributor 36, the pressure in any pneumatic cushion 14, or combination of cushions, may be measured, increased or decreased. By sequential scanning of each tube 30 of each rib 12, comprehensive independent pressure measurement and control may be achieved for each pneumatic cushion 14.

A particular economy of the present invention is its use of a single pressure sensor 84 to measure the pressure in each of many separate pneumatic cushions 14. This feature greatly reduces both the cost and the complexity of the systems of the present invention. In order to prevent inaccuracies from arising due to the volume of main supply conduit 74, certain precautions must be taken, as will now be described.

One source of possible error in pressure measurements is the variation in residual pressure within main supply conduit 74. If main supply conduit 74 was last employed to measure the pressure in a pneumatic cushion at relatively high pressure, or to supply air at high pressure to a cushion, main supply conduit 74 will contain air at that pressure. Ideally, main supply conduit 74 would have a sufficiently small diameter that its internal volume would be negligible in relation to the volume of pneumatic cushions 14, but in practice, a small diameter would impose severe speed limitations on the system due to the increased time taken for the pressure to equalize along the conduit.

In order to standardize pressure measurements, it is therefore preferable to raise or lower main supply conduit 74 to a standard pressure before each pressure measurement. This is most simply achieved by opening exhaust valve 82 to lower the pressure within main supply conduit 74 to atmospheric pressure. Exhaust valve 82 is then closed before rib control system 32 opens the selected tube 30 corresponding to the next pneumatic cushion 14 undergoing measurement.

A further consideration in the measurement of cushion pressures is the affect that the measurement itself has on the pressure. The pressure actually measured is the final pressure after equalization between the initial pressure of the pneumatic cushion in question and the internal volume of main supply conduit 74 at atmospheric pressure. The final pressure will clearly be somewhat lower than the initial cushion pressure. For the most basic modes of operation of the present invention, this fact is not critical since the measured pressure is a precise indication of the cushion pressure immediately subsequent to the measurement process and is therefore a good basis for analysis and control of contact pressure patterns. For more complex modes of operation in which volumetric calculations are made, the process of pressure measurement is treated as release of a known quantity of air, as will be described below.

As mentioned above, a limiting factor for the minimum diameter of main supply conduit 74 is the time taken for pressure to equalize along its length. A typical choice for the internal diameter of main supply conduit 74 of about 6 mm, requires about 0.2 seconds for effective pressure equalization. It follows that each two-stage pressure measurement, i.e., residual pressure release from main supply conduit 74 followed by actual measurement, requires slightly less that ½ second. Control unit 86 preferably determines automatically when equalization has been achieved during the measurement process by identifying stabilization of the pressure within main supply conduit 74 as measured by pressure sensor 84.

Taking as an example a full-size pneumatic bed overlay having 200 independent pneumatic cushions (25×8), a complete cycle of pressure measurement would take approximately 1½ minutes. In a preferred embodiment, a twin main pressure control system 34 is used to control two halves of the pneumatic mattress in parallel. In this case, a first main supply conduit 74 having its own input valve 76, exhaust valve 82, and pressure sensor 84, supplies one set of ribs 12, and a second similar main supply conduit 74 supplies the remainder of the ribs (see FIG. 2). The time for a complete measurement cycle is then reduced to significantly less than 1 minute.

In a basic embodiment, adjustment of cushion pressures is achieved simply by selective opening of valves of distributors 36 for timed pulses while either input valve 76 or exhaust valve 82 is open, as appropriate. If the initial pressure of a cushion is known, the approximate amount of air entering or leaving the cushion may be derived from the length of time the distributor valve is opened together with the pressure difference between the supply or exhaust and the cushion.

In a preferred embodiment, more accurate adjustment of cushion pressures is achieved by measuring units introduced or released via a cell of known volume. Using the structure already described, this may be implemented employing main supply conduit 74 as a "volume cell". In other words, lowering of pressure is performed in steps each equivalent to the pressure measurement process described above. First, main supply conduit 74 is opened to the atmosphere. Then, the cushion pressure is allowed to equalize with the internal volume of main supply conduit 74 and the final pressure is measured. Since the final pressure, initial (atmospheric) pressure and internal volume of main supply conduit 74 are known, the exact mass of air released from the cushion can be calculated.

Similarly, the pressure of a given cushion may be increased by raising the pressure of main supply conduit 74 to a known elevated pressure and then allowing the pressure to equalize between main supply conduit 74 and the cushion. Again, since initial and final pressures within main supply conduit 74 are measured, the quantity of air supplied to the cushion may be deduced.

The only parameter relevant to the calculation of quantities of air supplied or released which is typically not directly measured is the temperature of the gas within main supply conduit 74. In order to improve accuracy of measurement, it may be preferable to perform the measured supply and release of air through a purpose-made volume cell having a high surface area and made of material with a high coefficient of thermal conductivity. Typically, the volume cell is constructed as a flattened hollow rectangular block made of aluminum or copper. Functionally, the volume cell replaces the internal volume of main supply conduit 74 as the "cell" for measuring purposes. In other respects, the operation of the system remains similar to that described above, except that pressure measurement is typically performed by opening both sides of the volume cell.

It will be appreciated that the exact measurement of the quantity of air introduced or released from each pneumatic cushion allows very sophisticated measurement and control of pneumatic mattress system 10. For example, given a known initial cushion inflation pressure, initial volume and generally constant cross-sectional area, since the net amount of air removed and the current pressure in each cushion is known, it is possible to construct an exact contour map of the height of each cushion. Thus, pneumatic mattress system 10 can be programmed to store, analyze or actively produce a specific contour map without the need for the complex and often inoperative systems described in the prior art for height measurement.

To conclude the description of the structure of the pneumatic mattress systems of the present invention, control unit 86 preferably includes a memory for storing pressure measurements, and a processor for analyzing the pressure measurements and to control the system in accordance with its analysis. Details of the algorithms with which the processor is to be programmed will be understood from the description of the operation of the system which follows below. The systems also typically include a display screen and/or a printer for providing a visual representation of the measurements stored in the memory or of the analysis performed by the processor, a standard computer interface for downloading information to other systems or a database, and a keyboard for controlling operation of the system and inputting additional information when required, as will be discussed below.

Turning now to the operation of the present invention, this will be described with reference to FIGS. 11–17. It should be appreciated that the structure of pneumatic mattress system 10 described above provides an extremely versatile tool for implementation of a wide range of diagnostic testing, preventative therapy techniques and therapeutic treatment. The following description presents a number of specific examples from which one may better understand the operational principles of the system. However, it should be noted that many of the features described in different modes of operation may in fact be combined or performed concurrently.

Figure 11:
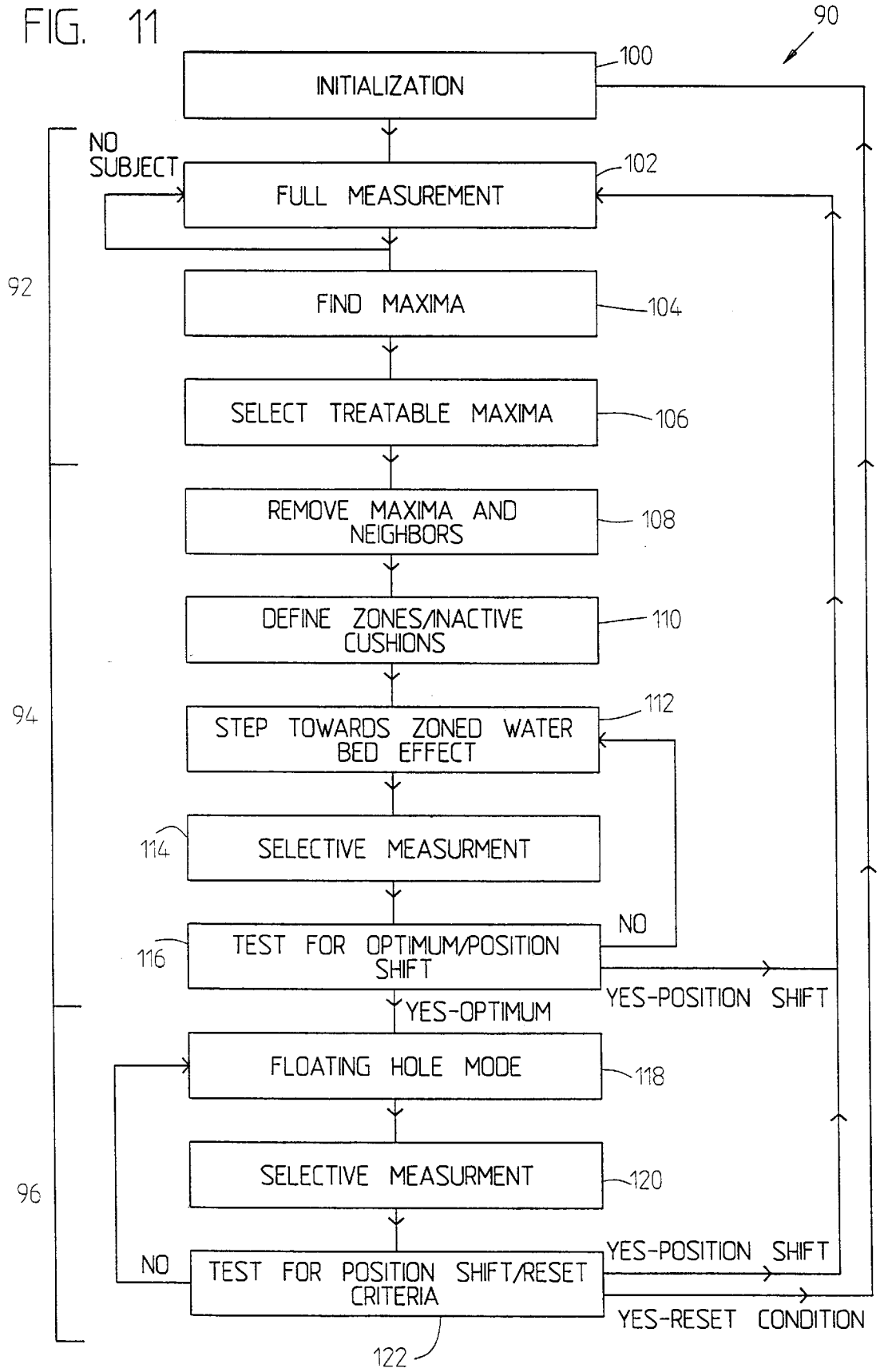
FIG. 11 is a high-level flow diagram illustrating a first preferred mode of operation of a pneumatic mattress system according to the present invention.

Referring first to FIG. 11, this shows an example of a basic mode of use of the systems of the present invention, generally designated 90. Generally speaking, basic mode 90 has three phases: firstly, a diagnostic phase 92 in which pressure patterns are measured and analyzed; secondly, a pressure distribution phase 94 in which pressure is distributed by a localized water-bed-type effect; and, thirdly, a selective pressure-release phase 96 in which pressure is temporarily released from selected critical areas.

Turning now to the features of basic mode 90 in more detail, the mode starts with an initialization step 100 in which each pneumatic cushion 14 is raised to a known initial pressure. In the simplest case, initialization step 100 is performed before the subject rests on the bed. In this case, it is clear that the known initial pressure also corresponds to a known initial volume. However, it is preferable that initialization step 100 also functions as a "warm reset" which may be performed while the subject is lying on pneumatic mattress system 10. A form of initialization step 100 suitable for use as a warm reset will be described below in detail with reference to FIG. 12.

After initialization, basic mode 90 is ready for diagnostic phase 92. The system preferably then performs intermittent scattered pressure measurements to detect whether a subject is yet lying on the bed. If the bed remains unused for a prolonged period, initialization step 100 is repeated to prevent significant pressure loss through repeated measurement.

Diagnostic phase 92 begins shortly after a subject has been detected lying on the bed with a full measurement 102 of the pressure in each pneumatic cushion 14. As mentioned above, this measurement typically takes significantly less than one minute. The measured values are stored in the memory of control unit 86.

Next, the processor of control unit 86 processes the measured values to identify a number of pneumatic cushions 14 which correspond to local maxima of the measured cushion pressures as "peak cushions". In its simplest form, this step may be implemented as a series of nearest neighbor comparisons. This step is designated 104.

It is a preferred feature of the operation of the systems of the present invention that the peak cushions are screened to identify untreatable maxima. The term "untreatable maximum" is used herein, in the specification and claims, to refer to a highly localized or discontinuous pressure maximum in which high pressure is exerted on a single cushion or a few adjacent cushions which are immediately surrounded by cushions at a much lower pressure. This situation commonly occurs when a subject is leaning on his elbow. In such a case, the maximum is termed "untreatable" since the pressure cannot be distributed by reducing the cushion pressure at the maximum or raising the cushion pressure in surrounding cushions. In fact, attempts to treat such maxima in the standard manner would be destructive leading to "bottoming-out" in which he subject is left resting on the solid surface underlying the cushions.

In order to prevent attempts to treat untreatable maxima, basic mode 90 includes a step of selecting treatable maxima, denoted 106. This step is easily performed by comparing the measured cushion pressure of each peak cushion with the measured cushion pressures of proximal cushions. It should be noted that the word "proximal" in this context does not necessarily imply immediate adjacency. In fact, processing is typically performed on measured pressures over a range of several cushions from the maximum.

Optionally, a step 108 may now be included for immediately decreasing cushion pressures in some or all of the treatable maxima and any of their neighbors which have unacceptably high measured pressures. Although the same results will be achieved in the subsequent steps of basic mode 90, it may be preferable to ameliorate points of particularly high pressure immediately.

It is a particular feature of the operation of preferred embodiments of the present invention that pneumatic cushions 14 are temporarily classified into active and inactive cushions. For this purpose, inactive cushions are generally defined as those cushions which are not currently supporting the subject. As long as the subject does not significantly alter his body position, subsequent adjustment and measurement steps may be limited to active cushions only, thereby greatly reducing the time taken for each step. Inactive cushions are easily identified in step 110 by their uniform distribution of measured pressures close in value to their initialization pressure.

It is another particular feature of the operation of preferred embodiments of the present invention that pressure distribution is performed within zones defined in relation to the position of the subject's body. In basic mode 90, this is achieved in step 110 by further analysis of the measured cushion pressures.

Parenthetically, it should be noted that the division of basic mode 90 into diagnostic phase 92, pressure distribution phase 94 and selective pressure-release phase 96 is somewhat arbitrary. For example, step 110 could reasonably be considered to form part of diagnostic phase 92.

Specifically, after excluding inactive cushions and cushions attributed to untreatable maxima, the remaining active cushions are divided up into a number of working regions. Each working region is made up of a plurality of the pneumatic cushions and includes at least one peak cushion. Typically, the working regions are defined such that a bridge of minimum or relatively low pressure cushions forms a boundary between working regions containing adjacent peak cushions. In a case in which two peak cushions fall geometrically close together, for example within a span of about four cushions, they are preferably included in the same working region.

Once the working regions have been defined, an adjustment step 112 is performed on each working region. Within each working region, the pressure within at least some of the pneumatic cushions is adjusted so as to approach equalization of cushion pressures over that region. Adjustment step 112 is most simply performed by simultaneous opening of all the valves of each distributor 36 which correspond to pneumatic cushions 14 of a given working region. This allows equalization of all cushion pressures within the region, corresponding to a localized water-bed-type effect.

In most cases, however, it is preferable to maintain more precise and better defined control over the distribution of pressure. Specifically, the finite height of pneumatic cushions 14 may preclude complete pressure equalization within a given region because of the risk of "bottoming-out".

An alternative approach for implementing adjustment step 112 is to calculate which specific cushions require an increase in pressure and which require a decrease in pressure. The required changes are then made sequentially or in groups by selective connection to input valve 76 or exhaust valve 82 for appropriate timed pulses. In order to maintain precise control over the pressure profile, pressure changes are preferably made in small steps.

In the preferred embodiment, the pressure changes of adjustment step 112 are implemented with high precision by employing a cell of known volume, as described above.

It is preferable that cushion pressures are measured frequently, and between successive steps of pressure changes. This is represented by step 114. In general, only the pressures of active cushions need be measured, thereby reducing measuring cycle time to a fraction of a minute. At step 116, these measurements are employed to determine whether the subject has shifted his body position significantly, or whether an optimal pressure distribution has yet been reached. If the measured pressures differ significantly from the expected values, it is likely that a shift of body position has occurred. In this case, the system returns to step 102. If optimal pressure distribution has not yet been achieved, the system returns to step 112.

It should be noted that adjustment step 112 and measurement step 114 are not necessarily independent steps. Specifically, according to the preferred manner of pressure adjustment, adjustment of the pressure of a given cushion also renders a measurement of the final pressure within the cushion.

It is also preferable that selective pressure measurement 114 be replaced intermittently with a full measurement cycle in which all cushion pressures are measured. This full measurement serves as an additional check for otherwise undetected shifts of body position.

Once step 116 has determined that optimal pressure distribution has been achieved, the system proceeds to selective pressure-release phase 96. In this phase, the pressure in selected pneumatic cushions is reduced sufficiently to effectively remove all contact pressure with the skin of the subject. The resolution of the pneumatic mattress systems of the present invention is such that the pneumatic cushions surrounding the "released" cushion support the body of the subject without causing any discomfort. After a certain time period, the released cushion is returned to its previous pressure and a different cushion is released. This step is referred to descriptively as a floating hole mode 118.

It is a particular feature of certain embodiments of the present invention that selection of pneumatic cushions to be released by floating hole mode 118 is correlated to the location of the pneumatic cushions identified in diagnostic phase 92 as peak cushions. This ensures that the areas of the body most at risk of pressure-related problems are given maximum opportunity to recover from the effects of any pressure applied to them.

Floating hole mode 118 may also be implemented advantageously by working regions. Generally, one "floating hole" will be generated per working region.

In order to verify that floating hole mode 118 is functioning as intended and to detect any significant change in body position of the subject, a pressure measurement step 120 and a test for position shift 122 are performed intermittently. Steps 120 and 122 parallel steps 114 and 116 above.

It is a further preferred feature of step 122 that a test is performed for "reset criteria". Reset criteria are defined herein as criteria for determining whether operation of pneumatic mattress system 10 has strayed outside its normal range of operating parameters or has accumulated an unacceptable cumulative error in measurement. Typically, the reset criteria include conditions of under-inflation of a high proportion of pneumatic cushions 14, and conditions of prolonged system operation since the previous initialization step. Provisions are also made for manual actuation of the reset procedure. When criteria for requiring reset are detected, basic mode 90 returns to initialization step 100.

Figure 12:
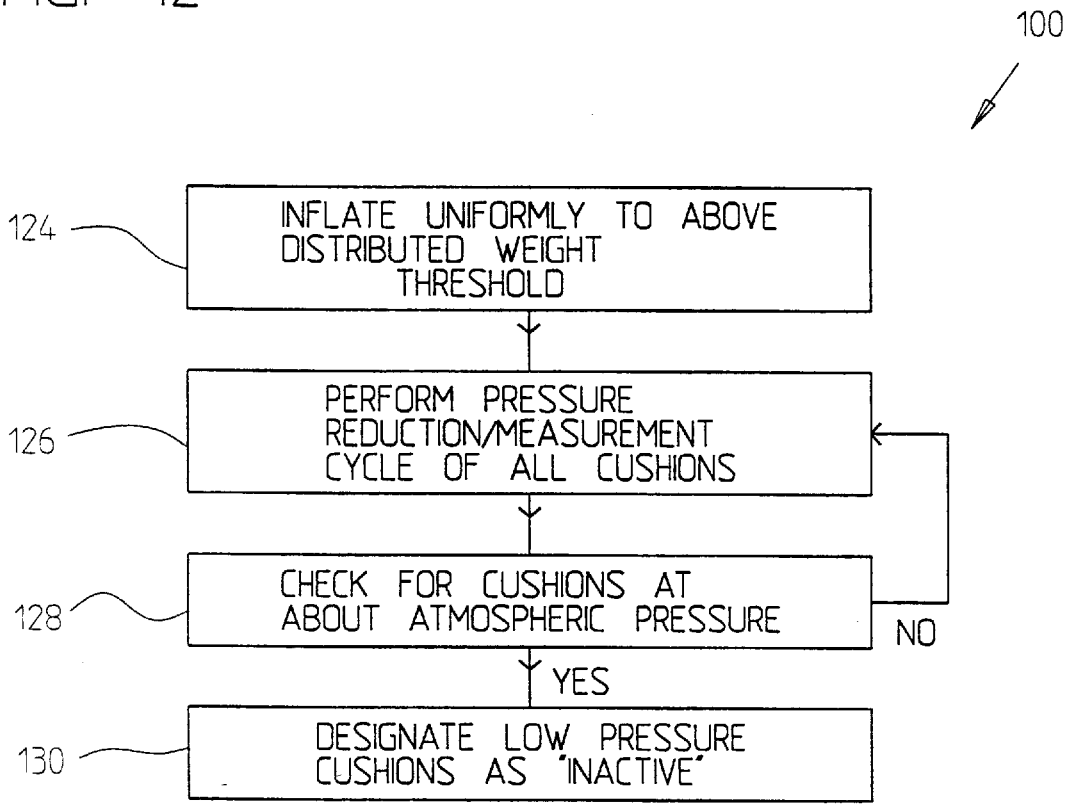
FIG. 12 is a flow diagram illustrating performance of a preferred initialization reset sequence for a pneumatic mattress system according to the present invention.

Referring now to FIG. 12, a form of initialization step 100 suitable for use as a warm reset will be described. Given presumed or measured information about the body weight and area coverage of a subject lying on pneumatic mattress system 10, it is possible to define a distributed weight threshold equal to the maximum pressure expected to be exerted by the subject on any single cushion. Typically, it has been found that a value of about 1.2–1.3 atm. is sufficient. In practice, a suitable pressure may be determined by identifying the maximum measured cushion pressure.

Initialization step 100 preferably starts at step 124 by raising all cushions 14 uniformly to slightly above the distributed weight threshold pressure. This has the effect of lifting the subject until the surface tension of the material of the cushion balances the excess pressure above that exerted by the weight of the subject. Since the material of the cushions is substantially non-stretchable, this process substantially fully inflates all of the cushions independent of the position of the subject on the mattress. In this manner, an initialization condition in which each cushion has a known pressure and known volume is achieved.

Clearly, the fully inflated state generated by step 124 results in an extremely hard mattress surface which is unsuited to most applications of the system. Step 124 is therefore immediately followed by a cycle of pressure reduction and measurement in all cushions (step 126). Step 126 is preferably implemented through the precise adjustment process employing a volume cell, as described above.

Return to normal operating conditions is easily identified at step 128 by checking for cushions at close to atmospheric pressure. Since a subject generally rests on no more than about half of pneumatic cushions 14 at any given time, a large number of cushions will have little or no loading. For these cushions, as soon as sufficient air has been released to reduce the surface tension in the cushion material, the pressures measured will be close to atmospheric. If no such "low" pressure cushions are found, pressure reduction step 126 is repeated. The clear pressure differential between loaded and unloaded cushions allows an optional step 130 of immediately classifying currently inactive cushions for time savings in subsequent measurements.

In addition to the operational functionality described above, the systems of the present invention also have the capability of supplying useful diagnostic information. For example, the pressure measurements collected at step 114 allow a convenient determination of the body weight of the subject without requiring his removal from the mattress. It is important to note that weight calculations are best made based on measurements performed after pressure distribution since this ensures maximal contact area with each cushion thereby yielding most accurate results. For highly accurate results, the processor of control unit 86 may be programmed to calculate weight readings repeatedly at a given time interval or stage of system operation and an average reading may be derived.

The system of the present invention also provides a powerful diagnostic tool capable of producing a quantitative assessment of risk factors of developing contact-pressure related ailments according to various evaluation schemes. Since, in basic mode 90, the system responds each time the subject shifts his body position significantly, processor of control unit 86 may readily be programmed to perform statistical analysis on the frequency of body shifts. In this way, pneumatic mattress system 10 may provide assessment functions concurrently with normal operation. Alternatively, pneumatic mattress system 10 may function in an exclusively diagnostic mode, if required.

Figure 13:
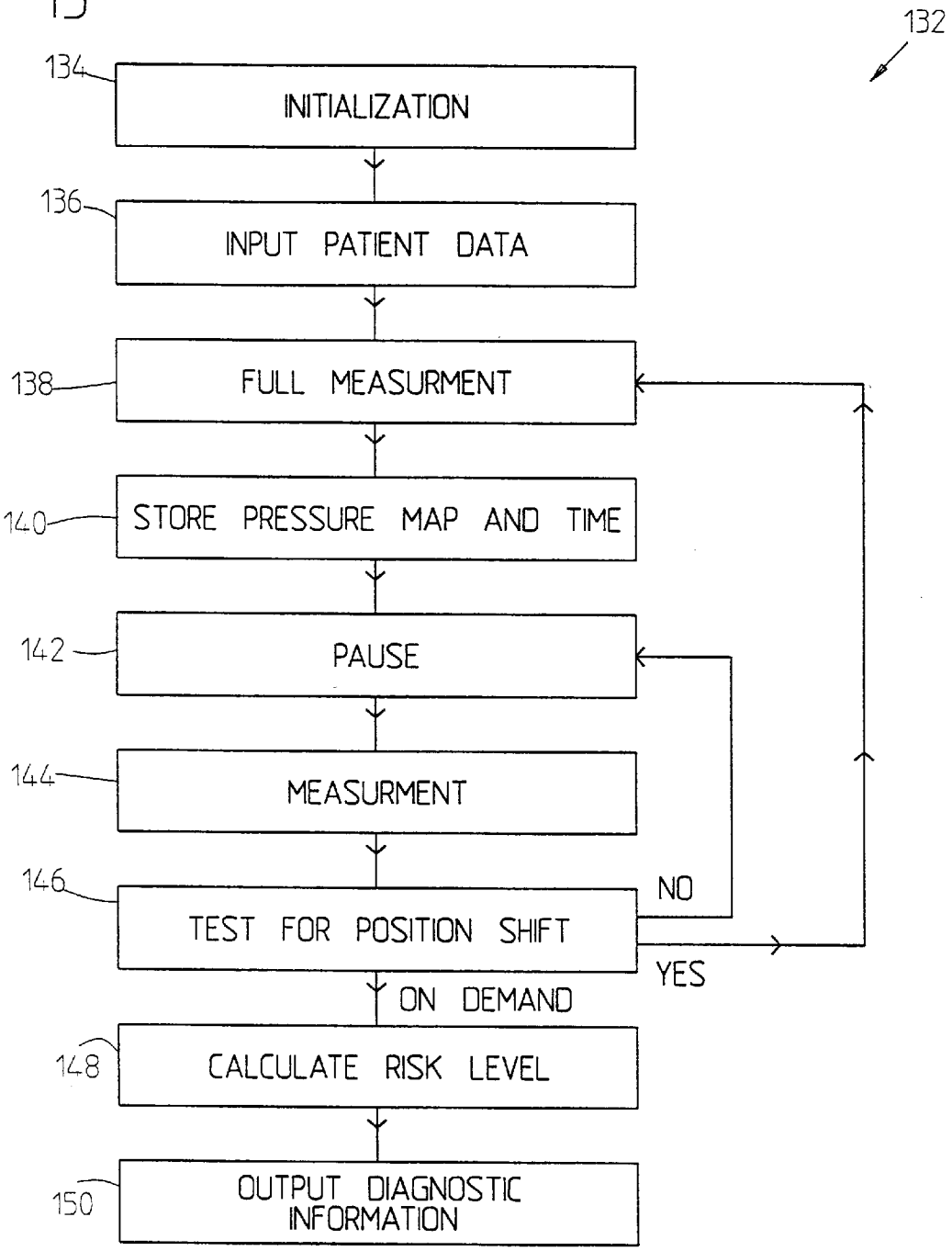
FIG. 13 is a high-level flow diagram illustrating the operation of a pneumatic mattress system as an assessment tool according to the present invention.

The operation of pneumatic mattress system 10 as an assessment tool will now be described with reference to FIG. 13. FIG. 13 shows an assessment mode of operation, generally designated 132, illustrated by way of example dissociated from other modes of operation. Assessment mode 132 begins with an initialization step 134 which may be similar to initialization step 100 described above. An opportunity is also provided for input 136 of patient data relevant to the assessment scheme to be used. Typically, known scales such as the Norton scale and Braden scale require basic physiological patient information such as age and weight, as well as details of a number of other contributory factors such as smoking habits and diabetes etc. The data is typically input using a keyboard or push-button interface with a graphic display prompt for each question. Clearly, it is not critical at what stage of the assessment process the patient data is provided.

Assessment mode 132 then performs a full pressure measurement 138 as described above and stores the measured data as a time-referenced digital pressure map (step 140). This allows the system to generate a display or printout of a map of measured cushion pressures or "contact pressure profiles" at any given time, or as a timed sequence. Display of a sequence of contact pressure profiles as a moving display is a powerful diagnostic tool, enabling identification of problematic areas of the body and analysis of body movements.

After a given pause 142, a selective or full pressure measurement 144 is performed, and the results are compared with the previous measured pressures to test for any significant position shift (step 146). If no significant position shift is detected, the process pauses again returning to step 142. If a significant position shift is detected, assessment mode 132 returns to step 138 to measure and record the new pressure pattern and time.

It should be noted that the definition of a "significant position shift" may vary according to the assessment criteria. Minimally, it is intended to exclude minor movements such as marginal shifting of a single limb. Such minor movements can be simply excluded by suitable definition of the parameters of comparison between pressure maps. In a more sophisticated system, it may be preferable to exclude lateral translation of even the entire body as long as the general pattern of pressures remains close to equivalent.

When sufficient data has been collected, or in response to a manual request for output, assessment mode 132 proceeds to calculate a risk level according to one or more evaluation scheme 148. Typically, the risk level will be a function of at least subject mobility in terms of average time between body movements. It will be readily apparent that the present invention provides a precise measurement of this parameter which has conventionally been limited to a highly inaccurate human estimation and "guesswork". Calculation of the risk level may also involve analysis of at least one pressure distribution map. As mentioned earlier, the subject's weight may also be derived directly by the system during operation.

The system may also output other diagnostic information 150. As mentioned earlier, this may be in the form of a printed or other graphic display of a series of pressure maps, as well as any statistical analysis of mobility or other factors of interest.

Turning now to FIGS. 14–17, these illustrate an example of an advanced mode of use of the systems of the present invention, generally designated 152. Generally speaking, advanced mode 152 is similar to basic mode 90 differing primarily in the data processing techniques employed.

Specifically, advanced mode 152 employs pattern recognition algorithms for identifying the body position of the subject resting on the mattress. As a result, the system may be programmed with personal information about the subject such as the location on his body of a wound or sore. The system then identifies when this part of the subject's body is in contact with the mattress and, if required, completely releases the contact pressure in that area.

Figure 14:
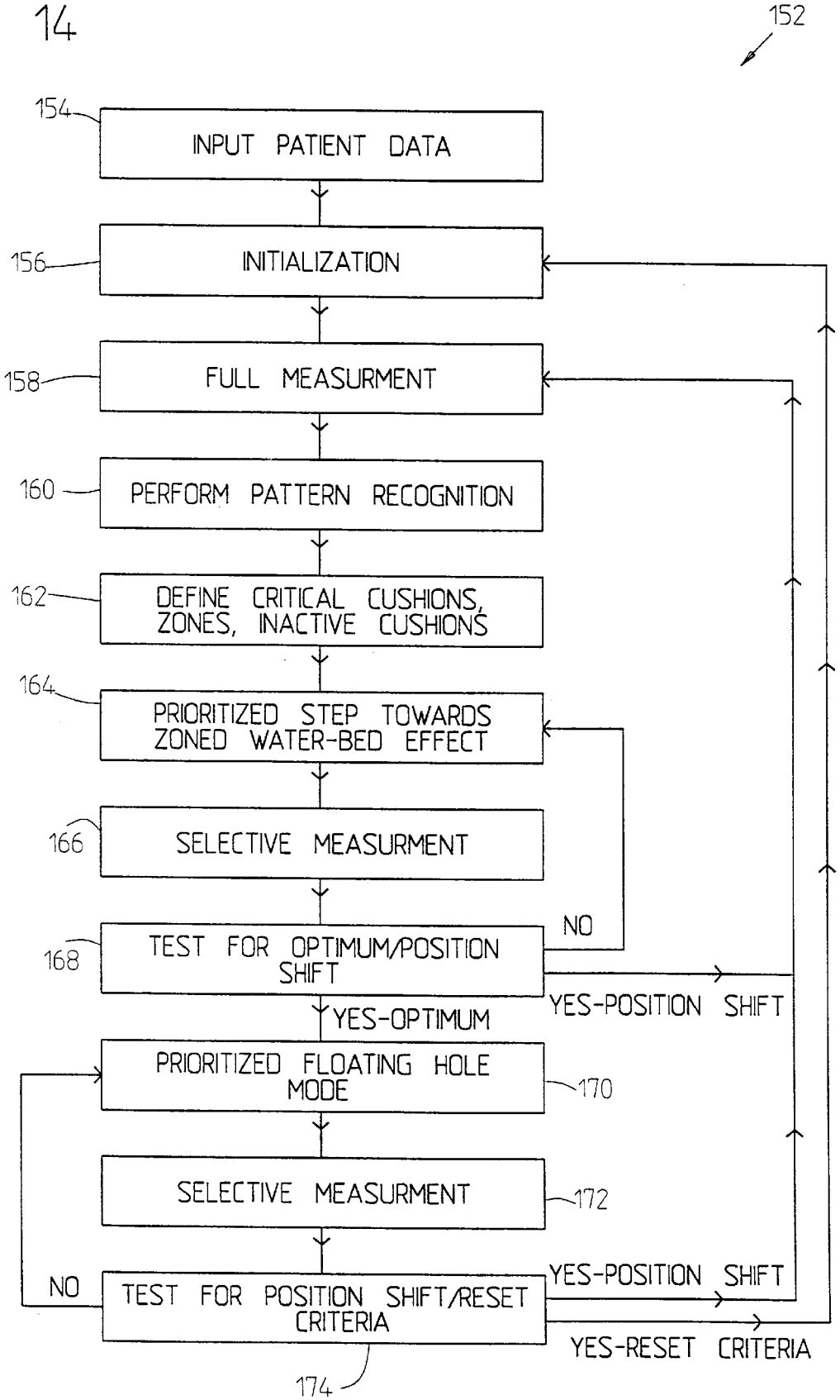
FIG 14 is a high-level flow diagram illustrating a further preferred mode of operation of a pneumatic mattress system according to the present invention which employs pattern recognition techniques.

Referring now to FIG. 14 in more detail, advanced mode 152 begins at step 154 with input of patient data. In this case, the data of importance to operation of the system is physiological data relating to the position on the body of the subject of wounds, sores or other conditions or features for which applied pressure may cause or aggravate medical problems or discomfort.

Figure 15:
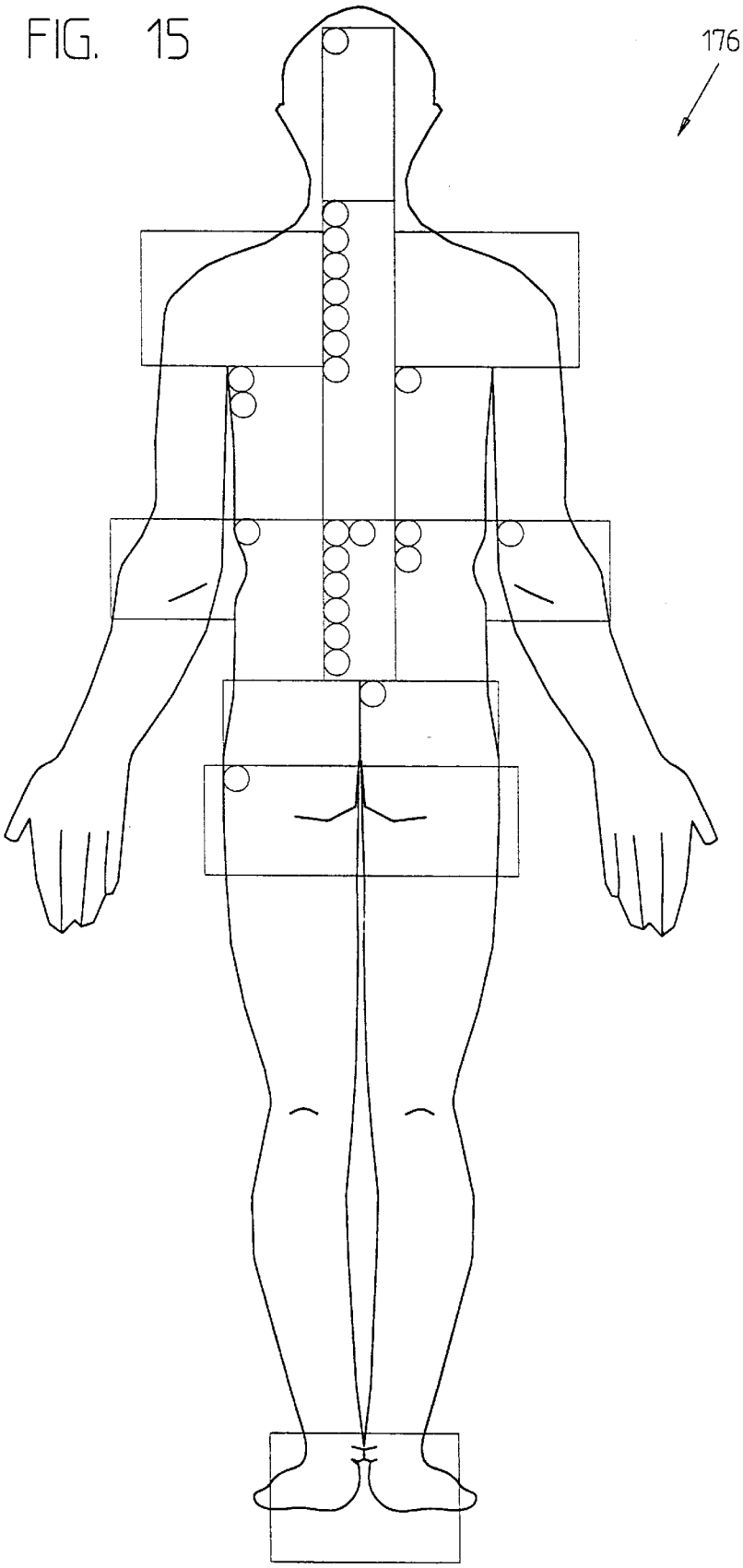
FIG. 15 is a schematic representation of an input interface for use in the mode of FIG. 14.

Input of patient data is typically performed through a graphic interface specifically designed for this purpose. FIG. 15 illustrates a "map" 176 of the posterior body surfaces of a patient as is displayed for data input. An operator then employs a conventional input device such as cursor keys or, if a touch sensitive screen is used, finger contact, to mark the position of one or more critical area defined on the body of the subject. The designation of critical areas may be performed to a resolution of about a few centimeters, and may be classified by zones.

Typically, four appropriately shaped input screens are employed, either in parallel or sequentially on a single screen, to enable accurate indication of critical areas on the anterior, left and right body surfaces. Information is preferably also entered indicating the nature of each critical condition and its current state. This may then be employed to select an appropriate mode of pressure release operation.

Advanced mode 152 then proceeds with initialization 156 and full measurement 158 parallel to steps 100 and 102 described above with reference to FIG. 11.

Then, at step 160, the measured cushion pressures are analyzed to derive information relating to the current position of the subject on the pneumatic mattress. Specifically, the object of the analysis is to identify the position, orientation and limb position of the subject lying on the mattress, and hence to derive what areas of the subject's body surface are currently in contact with the mattress.

The analysis required in step 160 may be performed using a wide range of pattern recognition algorithms which are well known in the field of image processing and do not, per se, form a part of the present invention.

Figure 16:
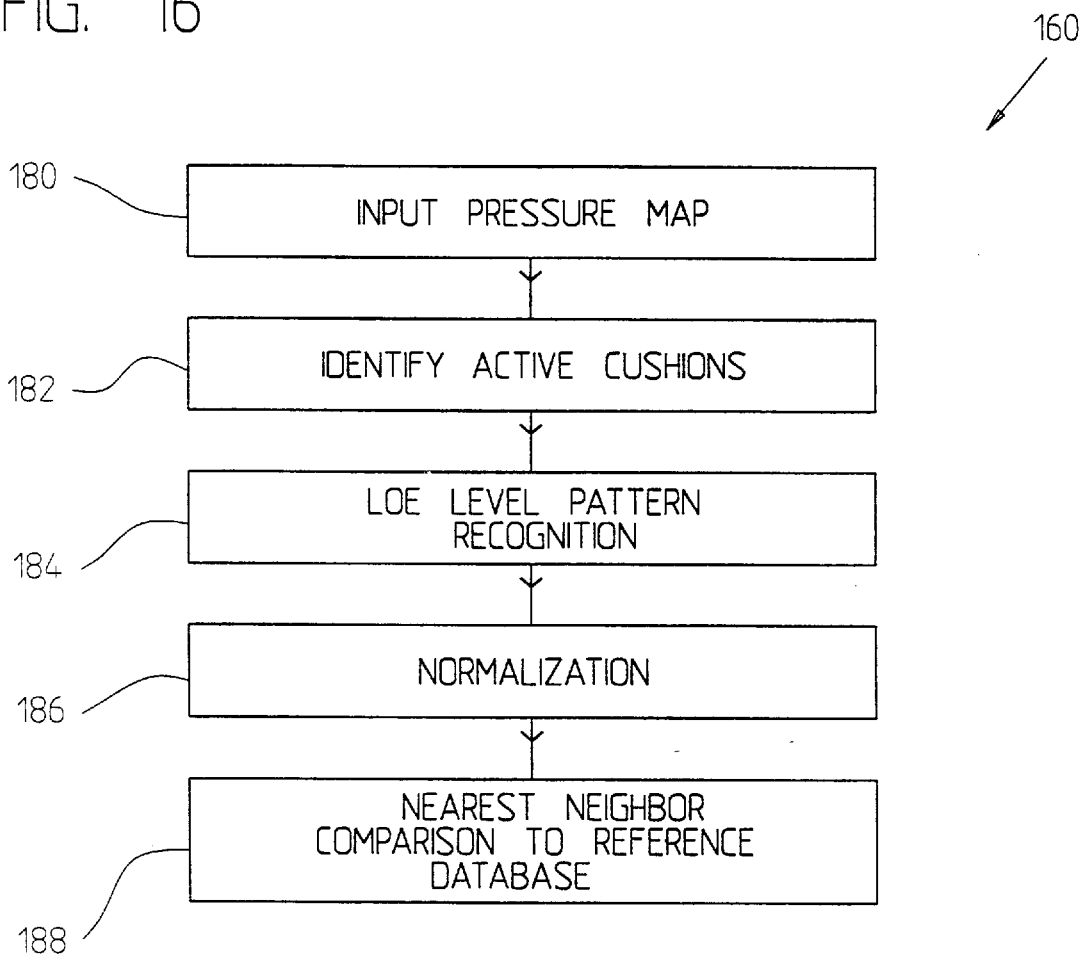
FIG. 16 is a flow diagram illustrating a possible implementation of the pattern recognition of the mode of FIG. 14.
Figure 17A:
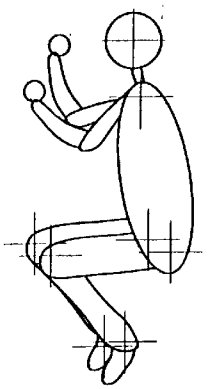
FIGS. 17A–17F are schematic illustrations of a few database reference elements for use in a possible implementation of the pattern recognition of the mode of FIG. 14.
Figure 17B:
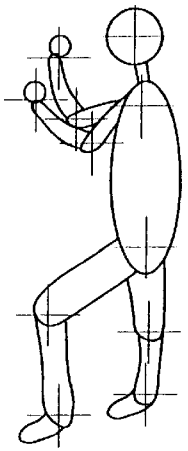
Figure 17C:
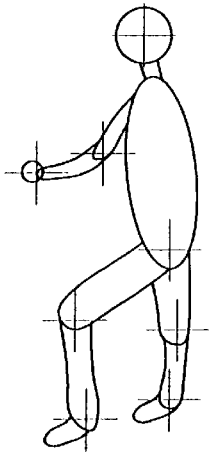
Figure 17D:
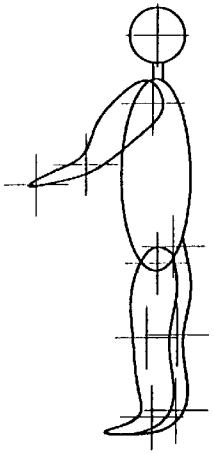
Figure 17E:
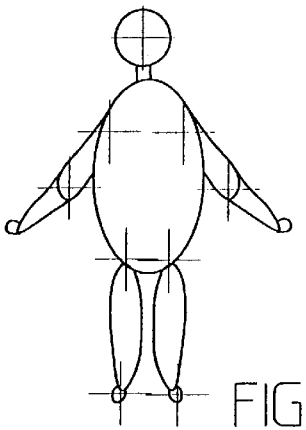
Figure 17F:
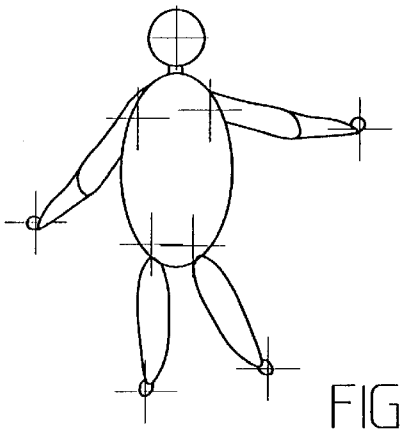

By way of example only, an outline of a suitable method of pattern recognition 160 based on nearest-neighbor comparison is shown in FIG. 16. This begins at step 180 by inputting the pressure map measured in step 158, and identifying active cushions 182. Then, at step 184, low-level pattern recognition is performed to identify basic elements such as elongated lines (e.g., limb segments), broad blocks (e.g., back/front of trunk) and points (e.g., contact points of elevated limbs). The derived features are then transformed (step 186) into a normalized frame of reference by translation, rotation and/or scaling such that, for example, they are described in a coordinate frame fixed relative to a centroid of the image and with a given measure of spread thereabout. A nearest-neighbor comparison 188 is then performed on the normalized image to find the closest match in a reference database. The database may be based on a priori knowledge of a limited number of significantly distinct possible body positions, or may be "recorded" during a training period. FIGS. 17A–17F illustrate a number of possible database records corresponding to positions of a subject lying on his right side or his back. Patterns for the left side mirror those for the right. Situations in which the subject lies on his front are rare for patients of the type typically likely to use the system, but such a case is readily differentiated from patterns of a subject lying on his back by the pressure patterns caused by the toes and the forearms.

Parenthetically, it may be noted that this type of pattern recognition may ideally be implemented using a self-training artificial neural network with a single hidden layer. In this case, multiple steps of the analysis described are performed simultaneously by the neural network.

Returning now to FIG. 14, once a nearest neighbor is identified, step 162 performs a reverse transformation to identify a number of critical cushions 14 which correspond to the current area of contact of the critical area of the subject's body with the mattress. Step 162 preferably also performs zoning functions in a manner similar to step 110 above.

The exact operation of the system with respect to the cushions identified as critical is preferably determined on the basis of information about the condition provided initially. In an extreme case, all contact pressure may be immediately released from the critical cushions to ensure maximum relief to the critical region of the subject's body. The remainder of mode 152 may then proceed in a manner parallel to mode 90 described above with the exclusion of the critical cushions.

In a less severe case, operation of the system may continue in a relatively normal manner, but giving priority in both pressure distribution and pressure release to the critical cushions. Thus, adjustment step series 164–168 is performed first for the zones containing critical cushions. Similarly, the pressure release of step 170 is automatically configured to give a high proportion of pressure release time to the critical cushions. Steps 172 and 174 parallel steps 120 and 122 above, respectively.

Finally, it will be appreciated that the flexibility and wide range of capabilities of the present invention allow it to be used for a wide variety of therapeutic functions. By way of example, the systems of the present invention may be programmed to perform lateral rotation therapy in which the patient is tipped alternately from side to side. The required effect is chieved simply by progressively raising and lowering cushion pressures in proportion to their position across ribs 12. Edge cushions 14*b* are maintained at a relatively high pressure to act as a safety restraint. In the standard overlay design described above, with a maximum cushion height of about 9 cm, lateral angles of ±20° can be achieved. In a system specifically intended to be used for lateral rotation therapy, taller cushions may be used to allow rotation up to angles of ±40°.

It will be appreciated that the above descriptions are intended only to serve as examples, and that many other embodiments are possible within the spirit and the scope of the present invention.

What is claimed is:

1. A pneumatic bed overlay comprising:

a plurality of hollow rigid ribs, each said rib having an approximately hexagonal cross section shape, said ribs being closely arranged side by side and hingedly interconnected at adjacent edges by a tightly interlaced plurality of flexible and substantially non-stretchable straps so as to prevent significant translational displacement between adjacent said ribs while allowing relative rotation to the extent of the sum of the angles formed between the respective opposing upper sides and opposing lower sides of adjacent said ribs, and a plurality of pneumatic cushions attached to the top side of each of said ribs so as to provide a cushioned surface.

2. A pneumatic bed overlay as in claim 1, wherein the angles of said hexagonal cross section shape of said ribs are configured so that said angles formed between adjacent said ribs are at least +/−30 degrees.

3. A pneumatic bed overlay as in claim 1, wherein the angle of said hexagonal cross section shape of said ribs are configured so that said angles formed between adjacent said ribs are up to +/−60 degrees.

4. A pneumatic bed overlay as in claim 1, further comprising a plurality of tubes mounted within each of said hollow rigid ribs, each of said tubes connecting pneumatically with at least one of said pneumatic cushions.

5. A pneumatic bed overlay as in claim 4, further comprising:

(a) a main pressure control system including:

(i) a main supply conduit, (ii) a valve controlled pressurized inlet to said main supply conduit, (iii) a valve-controlled exhaust from said main supply conduit, and (iv) a control unit for controlling said inlet and said exhaust; and (b) a rib control system associated with each of said ribs for selectively connecting between said main supply conduit and each of said tubes.

6. A pneumatic bed overlay as in claim 5, wherein said rib control system includes a microprocessor, said microprocessor being electrically connected to said control unit.

7. A pneumatic mattress system comprising:

(a) a plurality of pneumatic cushions deployed so as to form a substantially continuous surface over at least a region of the mattress;

(b) a plurality of tubes, each of said tubes communicating pneumatically with at least one of said pneumatic cushions; and (c) a main pressure control system including:

(i) a main supply conduit, (ii) a valve-controlled pressurized inlet to said main supply conduit, (iii) a valve-controlled exhaust from said main supply conduit, (iv) a plurality of local valves for selectively connecting between said main supply conduit and each of said tubes, and (v) a control unit for controlling said inlet, said exhaust and said local valves so as to control each of said pneumatic cushions substantially individually.

8. A pneumatic mattress system as in claim 7, wherein a majority of said pneumatic cushions each corresponds to an area of not more than about 0.01 square meters.

9. A pneumatic mattress system as in claim 7, further comprising a pressure sensor associated with said main pressure control system for measuring pressure in said main supply conduit such that, when one of said local valves is open while said inlet and said exhaust are closed, said pressure sensor measures the pressure in a corresponding one of said pneumatic cushions.

10. A pneumatic mattress system as in claim 9, wherein said control unit includes a memory for storing information relating to pressures within said pneumatic cushions.

11. A pneumatic mattress system as in claim 10, wherein said control unit further includes a processor for processing said information relating to pressures within said pneumatic cushions so as to determine a preferred direction of pressure change for at least some of said pneumatic cushions.

12. A pneumatic mattress system as in claim 10, further comprising an output device for outputting said stored information relating to pressures within said pneumatic cushions.

13. A pneumatic mattress system as in claim 9 for use as an overlay for a conventional bed, the pneumatic mattress system further comprising a plurality of rigid ribs positioned side-by-side and hingedly interconnected so as to form a continuous overlay basis which is flexible in one direction, and wherein a number of said plurality of pneumatic cushions is attached to each of said rigid ribs so as to provide a cushioned surface.

14. A pneumatic mattress system as in claim 9, further comprising:

(a) a rigid board having an upper surface, said plurality of pneumatic cushions being mounted on said upper surface; and (b) a cut-out mattress having a top surface and an opening for receiving said rigid board such that said top surface and said plurality of pneumatic cushions form a substantially continuous bed surface.

* * * * *